US010241454B1

(12) United States Patent
Shinoya et al.

(10) Patent No.: US 10,241,454 B1
(45) Date of Patent: Mar. 26, 2019

(54) IMAGE FORMING APPARATUS CAPABLE OF SUPPRESSING NOISE GENERATED WHEN SECOND FIXING MEMBER CHANGES ITS POSITION RELATIVE TO FIRST FIXING MEMBER THROUGH CAM MEMBER

(71) Applicant: Brother Kogyo Kabushiki Kaisha, Nagoya (JP)

(72) Inventors: Shota Shinoya, Nisshin (JP); Yasuhiro Suzuki, Nagoya (JP)

(73) Assignee: Brother Kogyo Kabushiki Kaisha, Nagoya-Shi (JP)

( * ) Notice: Subject to any disclaimer, the term of this patent is extended or adjusted under 35 U.S.C. 154(b) by 0 days.

(21) Appl. No.: 16/025,237

(22) Filed: Jul. 2, 2018

(30) Foreign Application Priority Data

Sep. 28, 2017 (JP) ..... 2017-188304

(51) Int. Cl.
*G03G 15/20* (2006.01)

(52) U.S. Cl.
CPC ..... *G03G 15/2053* (2013.01)

(58) Field of Classification Search
USPC ..... 399/38, 67–70, 107, 110, 122, 320, 328, 399/329
See application file for complete search history.

(56) References Cited

U.S. PATENT DOCUMENTS 7,620,336 B2 * 11/2009 Yura ..... G03G 15/2064 399/67
8,559,837 B2 * 10/2013 Nakayama ..... G03G 15/2064 399/328
8,737,893 B2 * 5/2014 Fujiwara ..... G03G 15/2064 399/329
8,971,778 B2 * 3/2015 Suzuki ..... G03G 15/2064 399/329
9,715,199 B2 * 7/2017 Yoshida ..... G03G 21/1652

FOREIGN PATENT DOCUMENTS

JP 2014-077943 A 5/2014
JP 2014-219699 A 11/2014

* cited by examiner

*Primary Examiner* — Hoan Tran
(74) *Attorney, Agent, or Firm* — Burr & Brown, PLLC

(57) ABSTRACT

An image forming apparatus includes: a first fixing member; a second fixing member; a holding member; a cam member; an urging member; a spring member; a drive source; a transmission section; a regulating member; and a controller. The cam member is rotatable about an axis in a first direction and a second direction opposite to the first direction. The spring member has one end portion movable in interlocking relation with the cam member and another end portion whose movement is regulated by the regulating member. The spring member suppresses rotation of the cam member in the first direction while storing a restoring force by the rotation of the cam member in the first direction; and facilitates rotation of the cam member in the second direction while releasing the restoring force by the rotation of the cam member in the second direction.

8 Claims, 13 Drawing Sheets

150
155
187E
170B
170A
151
170
X150
187
188
R1
R2
FR1
TOP
BOTTOM
REAR
FRONT

IMAGE FORMING APPARATUS CAPABLE OF SUPPRESSING NOISE GENERATED WHEN SECOND FIXING MEMBER CHANGES ITS POSITION RELATIVE TO FIRST FIXING MEMBER THROUGH CAM MEMBER

CROSS REFERENCE TO RELATED APPLICATION

This application claims priority from Japanese Patent Application No. 2017-188304 filed Sep. 28, 2017. The entire content of the priority application is incorporated herein by reference.

TECHNICAL FIELD

The present disclosure relates to an image forming apparatus.

BACKGROUND

As disclosed in Japanese Patent Application Publication No. 2014-219699, there is conventionally known an image forming device including a fixing device. The fixing device is configured to heat a recording sheet while nipping the recording sheet between a fixing roller and a pressure roller to thermally fix a developer image on the recording sheet. The fixing device is provided with a pressure roller unit, a cam, a coil spring, and a drive source.

The pressure roller unit holds the pressure roller such that the pressure roller can be displaced between a pressure contact position (second pressure state) and a separation position (non-pressure state). In the pressure contact position, the pressure roller is in pressure contact with the fixing roller. In the separation position, the pressure roller is separated from the fixing roller. The cam is rotatable about an axis of a cam shaft in both a counterclockwise direction and a clockwise direction. The counterclockwise direction is an example of a first direction, and the clockwise direction is an example of a second direction. The cam has a cam surface. The distance between the cam surface and the axis of the cam shaft is reduced in the clockwise direction. The coil spring urges the pressure roller unit in an urging direction to bring the pressure roller toward the cam surface. The drive source generates a driving force to rotate the cam in both the counterclockwise direction and the clockwise direction.

When the cam is driven by the drive source to rotate in the counterclockwise direction, the cam surface allows the pressure roller unit to be displaced in the urging direction. Hence, the pressure roller is displaced to the separation position. On the other hand, when the cam is driven by the drive source to rotate in the clockwise direction, the cam surface pushes the pressure roller unit in a direction opposite to the urging direction. Hence, the pressure roller is displaced to the pressure contact position.

SUMMARY

Conventional fixing devices may generate abnormal noise such as collision noise between components. Specifically, in the fixing device disclosed in Japanese Patent Application Publication No. 2014-219699, there are typically provided components such as gears meshing with each other, a shaft hole and a shaft part fitted to each other between the drive source and the cam. A gap is formed between such components. When the cam is rotated, a position at which the pressure roller unit and the cam surface of the cam contact each other is displaced relative to the axis of the cam shaft. With this configuration, the direction in which the cam is rotated about the axis of the cam shaft by the urging force of the coil spring may be abruptly changed from the counterclockwise direction to the clockwise direction or from the clockwise direction to counterclockwise direction due to a change in the rotational posture of the cam. In such a case, the gap between the components is suddenly eliminated, which may generate abnormal noise such as collision noise between the components.

In view of the foregoing, it is an object of the disclosure to provide an image forming apparatus including a first fixing member and a second fixing member, the image forming apparatus being capable of suppressing generation of abnormal noise when the second fixing member changes its position relative to the first fixing member.

In order to attain the above and other objects, according to one aspect, the disclosure provides an image forming apparatus including: a first fixing member; a second fixing member; a holding member; a cam member; an urging member; a spring member; a drive source; a transmission section; a regulating member; and a controller. The second fixing member is configured to nip and heat a recording sheet in cooperation with the first fixing member to fix a developer image onto the recording sheet. The holding member holds the second fixing member such that the second fixing member can be displaced between a pressure contact position and a separation position. The second fixing member in the pressure contact position is in pressure contact with the first fixing member. The second fixing member in the separation position is positioned away from the first fixing member. The cam member is rotatable about a rotation axis in a first direction and a second direction opposite to the first direction. The cam member has a cam surface. A distance between the cam surface and the rotation axis is reduced in the second direction. The urging member urges the holding member in an urging direction such that the holding member moves toward the cam surface. The spring member has one end portion and another end portion. The one end portion is movable in interlocking relation with the cam member. The spring member is configured: to store a restoring force by the rotation of the cam member in the first direction and to suppress rotation of the cam member in the first direction; and to release the restoring force by the rotation of the cam member in the second direction and to facilitate rotation of the cam member in the second direction. The drive source is configured to generate a drive force for rotating the cam member in the first direction and the second direction. The transmission section is configured to transmit the drive force to the cam member. The regulating member is configured to regulate movement of the another end portion. The controller is configured to control the drive source: to provide rotation of the cam member in the first direction, permitting the cam surface to allow the holding member to be displaced in the urging direction to displace the second fixing member to one of the separation position and the pressure contact position; and to provide rotation of the cam member in the second direction, permitting the cam surface to allow the holding member to be displaced in a direction opposite to the urging direction to displace the second fixing member to remaining one of the separation position and the pressure contact position.

BRIEF DESCRIPTION OF THE DRAWINGS

The particular features and advantages of the embodiment (s) as well as other objects will become apparent from the following description taken in connection with the accompanying drawings, in which.

DETAILED DESCRIPTION

First Embodiment

Figure 1:
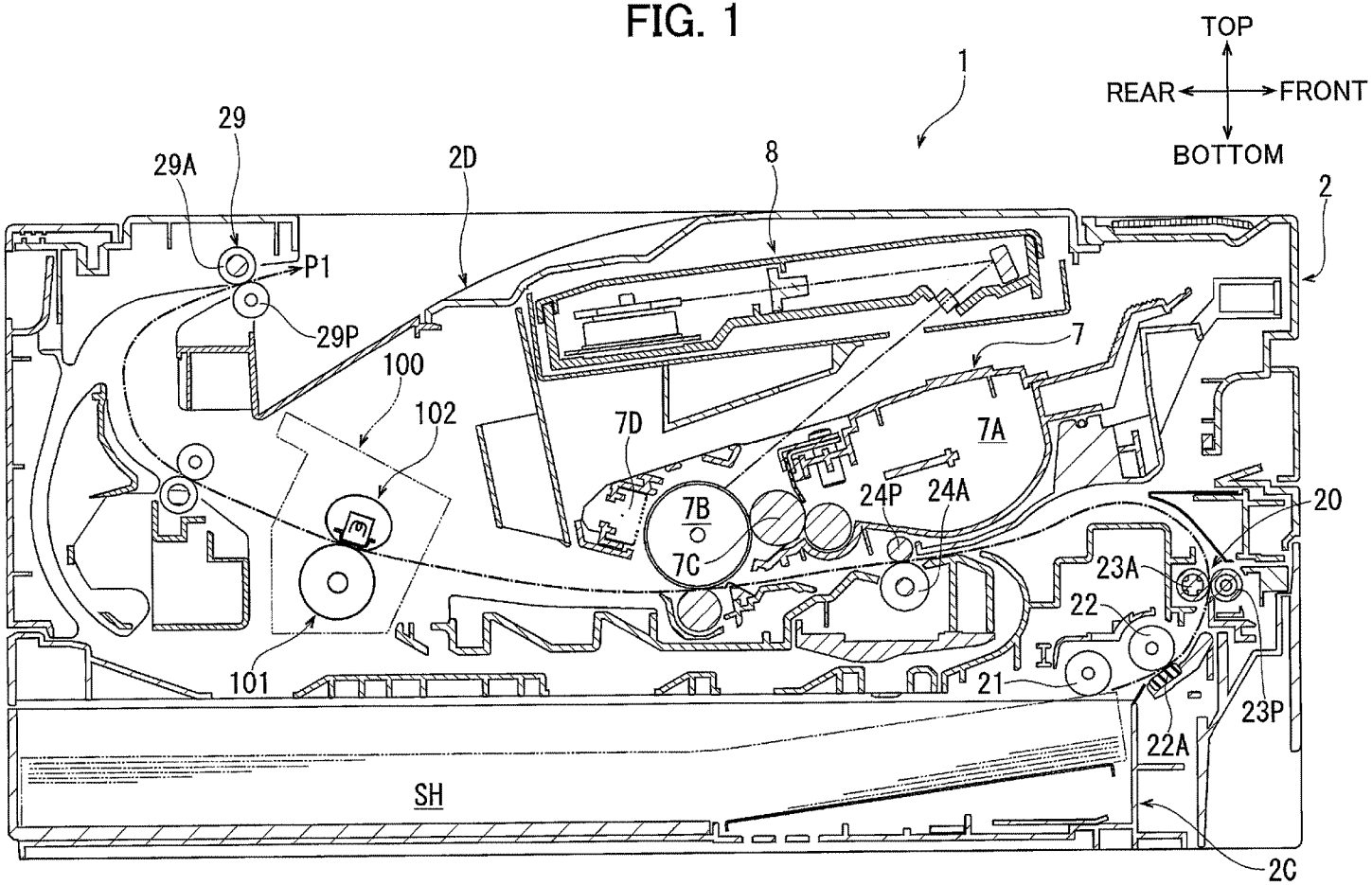
FIG. 1 is a schematic cross-sectional view of an image forming apparatus provided with a fixing device according to a first embodiment.

First, a general structure of an image forming apparatus 1 according to a first embodiment will be described with reference to FIG. 1. The image forming apparatus 1 illustrated in FIG. 1 is provided with a fixing device 100. A detailed structure of the fixing device 100 will be described later while referring to FIGS. 2 to 20G.

The image forming apparatus 1 is an electrophotographic laser printer configured to form an image on a recording sheet SH.

In FIG. 1, a right side of the drawing sheet is defined as a front side of the image forming apparatus 1. A left side of the image forming apparatus 1 is based on the perspective of a user viewing the image forming apparatus 1 from the front side. That is, a near side of the drawing sheet is defined as the left side of the image forming apparatus 1. An up-down direction, a front-rear direction, and a left-right direction are defined on a basis of the above definition. Further, directions indicated in each figure are based on the directions in FIG. 1.

<General Structure of Image Forming Apparatus>

As illustrated in FIG. 1, the image forming apparatus 1 includes a main body 2, a supply section 20, a process cartridge 7, a scanner section 8, the fixing device 100, and a discharge section 29.

The main body 2 includes a housing, and a frame member (not illustrated) provided in the housing. A sheet cassette 2C is positioned at a lower portion of the main body 2. The sheet cassette 2C is attachable to and detachable from the main body 2. A stack of recording sheets SH is accommodated in the sheet cassette 2C. In the present embodiment, the recording sheet SH may be a sheet of paper, an OHP sheet, an envelope, and the like.

A discharge tray 2D is provided at an upper surface of the main body 2. The discharge tray 2D is adapted to receive a recording sheet SH on which an image has been formed.

The supply section 20, the process cartridge 7, the scanner section 8, the fixing device 100, and the discharge section 29 are disposed inside the main body 2 at positions above the sheet cassette 2C, and are assembled to the frame member (not illustrated) of the main body 2.

A conveying passage P1 is provided in the main body 2, leading from a front end portion of the sheet cassette 2C to the discharge tray 2D. Specifically, the conveying passage P1 passes through the supply section 20 while U-turning upward from the front end portion of the sheet cassette 2C, and extends rearward in a substantially horizontal direction to pass through the process cartridge 7 and the fixing device 100, and then, U-turns upward to reach the discharge tray 2D through the discharge section 29.

The supply section 20 includes a supply roller 21, a separation roller 22, a separation pad 22A, a feed roller 23A, a pinch roller 23P, a registration roller 24A, and a pinch roller 24P. Each recording sheet SH accommodated in the sheet cassette 2C is supplied to the conveying passage P1 by the supply roller 21, the separation roller 22, and the separation pad 22A. The feed roller 23A, the pinch roller 23P, the registration roller 24A, and the pinch roller 24P are positioned along the conveying passage P1. The recording sheet SH supplied to the conveying passage P1 is then conveyed toward the process cartridge 7 by the feed roller 23A, the pinch roller 23P, the registration roller 24A, and the pinch roller 24P.

The process cartridge 7 includes a toner container 7A, a photosensitive drum 7B, a developing roller 7C, and a charger 7D.

The scanner section 8 is positioned above the process cartridge 7. The scanner section 8 includes a laser light source, a polygon mirror, an fθ lens, and a reflection mirror. The scanner section 8 is adapted to irradiate laser beam to the photosensitive drum 7B.

A surface of the photosensitive drum 7B is uniformly charged with positive polarity by the charger 7D while the photosensitive drum 7B rotates. Subsequently, the surface of the photosensitive drum 7B is exposed to laser beam irradiated from the scanner section 8 at a high scanning speed. In this way, an electrostatic latent image corresponding to an image to be formed on the recording sheet SH is formed on the surface of the photosensitive drum 7B. The developing roller 7C is adapted to supply developer (toner) accommodated in the toner container 7A to the surface of the photosensitive drum 7B. Accordingly, a developer image corresponding to the electrostatic latent image is formed on the surface of the photosensitive drum 7B. The developer image is then transferred onto the recording sheet SH passing through the process cartridge 7.

The fixing device 100 is positioned rearward of the process cartridge 7. The fixing device 100 includes a heating belt unit 102, and a pressure roller 101. The heating belt unit 102 is positioned above the conveying passage P1, while the pressure roller 101 is positioned below the conveying passage P1. The pressure roller 101 is positioned in confrontation with the heating belt unit 102, with the conveying passage P1 interposed between the heating belt unit 102 and the pressure roller 101. The recording sheet SH is heated and pressed while being nipped between the pressure roller 101 and the heating belt unit 102, so that the developer image can be thermally fixed onto the recording sheet SH.

The discharge section 29 includes a discharge roller 29A, and a discharge pinch roller 29P. The recording sheet SH on which the image is fixed is discharged onto the discharge tray 2D by the discharge roller 29A and the discharge pinch roller 29P.

Figure 2:
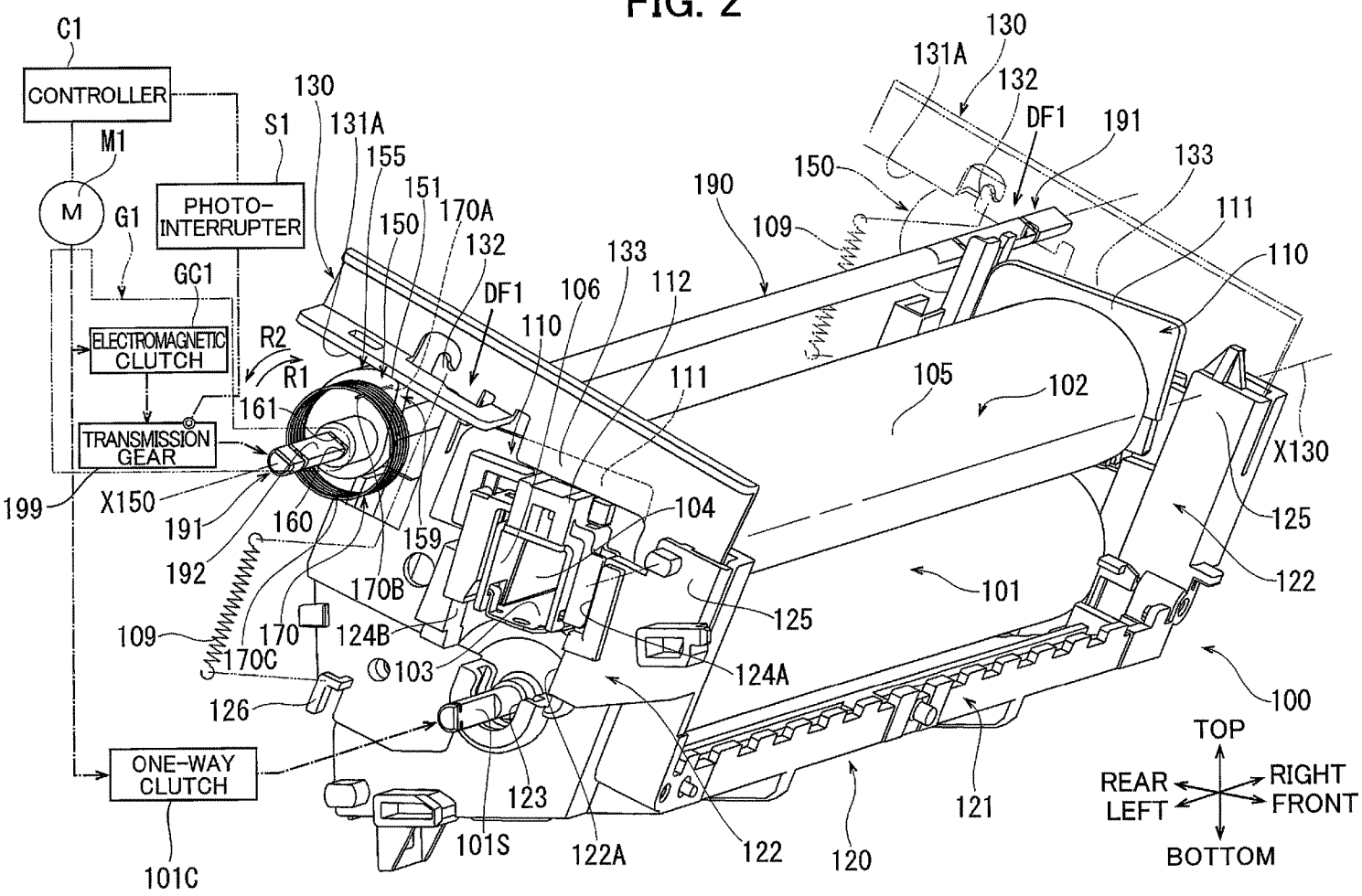
FIG. 2 is a perspective view of the fixing device according to the first embodiment.

As illustrated in FIG. 2, the image forming apparatus 1 is provided with a controller C1, a motor M1, a transmission section G1, and a photointerrupter S1. The controller C1 is configured of a microcomputer. The controller C1 primarily includes a CPU, a ROM, and a RAM (which are not illustrated). The ROM stores programs by which the CPU can control various operations of the image forming apparatus 1 and execute an identification process. The RAM is used as a storage area for temporarily storing data and signals used when the CPU executes the programs, or as a work area for data processing. The controller C1 is configured to control the entire image forming apparatus 1, that is, not only the fixing device 100 but also the supply section 20, the process cartridge 7, the scanner section 8, and the discharge section 29. The motor M1 is an example of a drive source. The motor M1 may be exclusively used for the fixing device 100, or may also be used as a drive source for the supply section 20, the process cartridge 7, and the discharge section 29. In the present embodiment, a stepping motor is used as the motor M1. The motor M1 is rotatable in a normal rotation direction and a reverse rotation direction under the control of the controller C1. The photointerrupter S1 is connected to the controller C1.

As illustrated in FIG. 2, the transmission section G1 primarily includes an electromagnetic clutch GC1, a gear train (not illustrated), a transmission gear 199, and a transmission shaft 190. The gear train couples the motor M1 and an input side of the electromagnetic clutch GC1. The transmission gear 199 is coupled to an output side of the electromagnetic clutch GC1. The electromagnetic clutch GC1 is connected to the controller C1 and configured to be switched between a connecting state and a disconnecting state under the control of the controller C1. The transmission shaft 190 is a shaft member formed of steel, for example, having high strength and rigidity. The transmission shaft 190 has left and right shaft portions 191 at left and right end portions thereof, respectively.

<Detailed Structure of Fixing Device>

Figure 3:
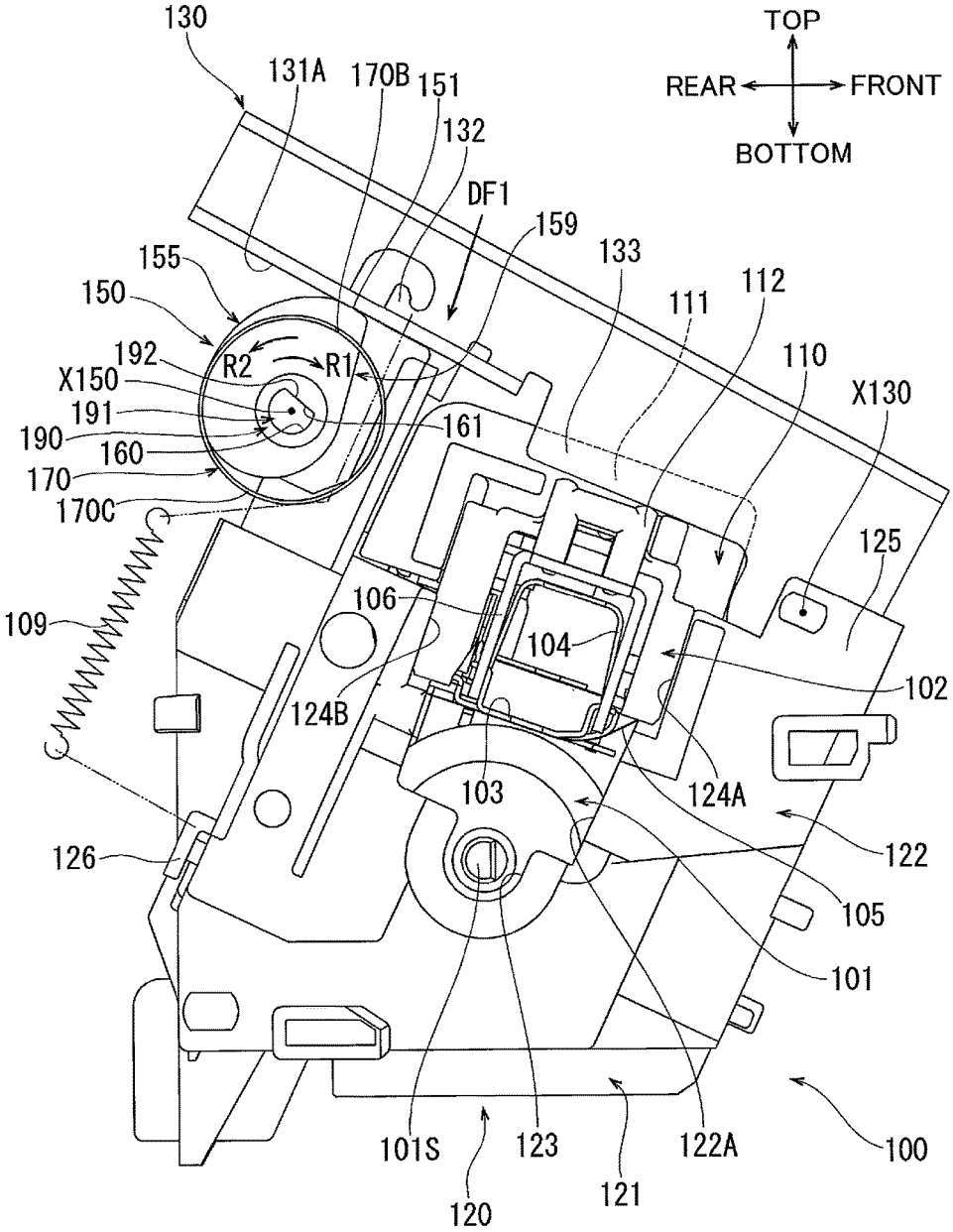
FIG. 3 is a side view of the fixing device according to the first embodiment.

As illustrated in FIGS. 2 and 3, the fixing device 100 includes the pressure roller 101, the heating belt unit 102, a fixing frame 120, a pair of left and right holding members 130, a pair of left and right cam members 150, and a pair of left and right tension coil springs 109.

The pressure roller 101 is an example of a first fixing member. The heating belt unit 102 is an example of a second fixing member. The tension coil spring 109 is an example of an urging member.

The left holding member 130 and the right holding member 130 are symmetrical in shape to each other. Therefore, illustration of the right holding member 130 is simplified. Further, the left cam member 150 and the right cam member 150 are symmetrical in shape to each other. Therefore, illustration of the right cam member 150 is simplified.

As illustrated in FIGS. 2 and 3, the fixing frame 120 includes a base portion 121, and a pair of left and right side wall portions 122. The base portion 121 is elongated in the left-right direction. The base portion 121 is supported by the frame member (not illustrated) of the main body 2.

The left side wall portion 122 is connected to a left end portion of the base portion 121. The left side wall portion 122 protrudes upward from the left end portion of the base portion 121 and extends in the front-rear direction. As illustrated in FIG. 2, the right side wall portion 122 is connected to a right end portion of the base portion 121. The right side wall portion 122 protrudes upward from the right end portion of the base portion 121 and extends in the front-rear direction. The left side wall portion 122 and the right side wall portion 122 are symmetrical in shape to each other. Therefore, illustration of the right side wall portion 122 is simplified.

As illustrated in FIGS. 2 and 3, the left and right side wall portions 122 each have a recessed portion 122A recessed rearward and downward from an upper edge thereof.

Further, each of the left and right side wall portions 122 has a pressure-roller support portion 123 at a lower portion of the recessed portion 122A, and liner guide portions 124A and 124B at an upper portion of the recessed portion 122A.

Further, each of the left and right side wall portions 122 has a holding-member support portion 125 at an upper-front corner portion thereof. A hook 126 is provided at each of the left and right side wall portions 122, protruding downward from a position slightly upward from a lower-rear corner portion thereof.

The pressure roller 101 is a roller rotatable together with a rotation shaft 101S extending in the left-right direction. The rotation shaft 101S is rotatably supported by the pressure-roller support portions 123 of the left and right side wall portions 122 through bearings (not illustrated).

As illustrated in FIG. 2, the rotation shaft 101S has a left end portion coupled to the motor M1 through a planetary-gear type one-way clutch 101C. Although not illustrated, the one-way clutch 101C includes an input gear to which a driving force of the motor M1 is transmitted, an output gear positioned away from the input gear and coupled to the rotation shaft 101S, an arm swingably movable about a rotation axis of the input gear, and a planetary gear supported at a distal end portion of the arm so as to rotate about its own rotation axis and constantly meshing with the input gear. When the motor M1 rotates in the normal rotation direction, the planetary gear is displaced to a position capable of meshing with the output gear, so that the driving force of the motor M1 is transmitted to the rotation shaft 101S upon meshing of the planetary gear with the output gear. As a result, the pressure roller 101 rotates in a counterclockwise direction in FIG. 4. On the other hand, when the motor M1 rotates in the reverse rotation direction, the planetary gear is displaced to a position separated from the output gear, so that transmission of the driving force from the motor M1 to the rotation shaft 101S is interrupted. As a result, the rotation of the pressure roller 101 is halted.

Figure 4:
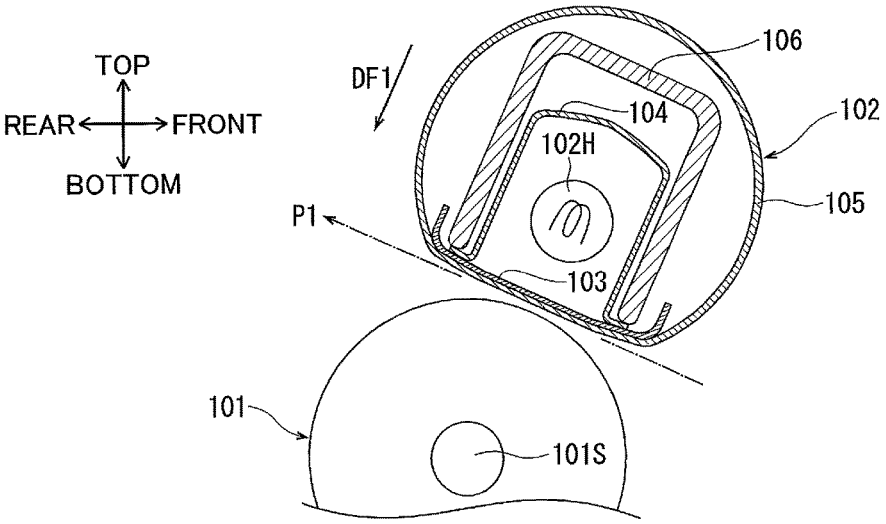
FIG. 4 is a schematic cross-sectional view of the fixing device according to the first embodiment, illustrating a state where a second fixing member is at a separation position.

The heating belt unit 102 includes a fusing belt 105, a heater 102H (which are illustrated in FIG. 4), a nip plate 103, a reflection plate 104, a stay 106 (which are illustrated in FIGS. 2 to 4), and a pair of left and right guide members 110 (illustrated in FIGS. 2 and 3). The left guide member 110 and the right guide member 110 are symmetrical in shape to each other. Therefore, illustration of the right guide member 110 is simplified.

As illustrated in FIG. 4, the fusing belt 105 is an endless belt having heat resistance and flexibility. The fusing belt 105 has a cylindrical shape and is elongated in the left-right direction. The fusing belt 105 is made of stainless steel, for example. The fusing belt 105 has an outer peripheral surface on which fluorine resin is coated.

Although not illustrated, both left and right end portions of the fusing belt 105 are guided by the left and right guide members 110, respectively, thereby allowing the fusing belt 105 to rotate. The fusing belt 105 provides an internal space in which the heater 102H, the nip plate 103, the reflection plate 104, and the stay 106 are disposed.

The heater 102H is a halogen heater, for example, and adapted to generate radiant heat to heat the nip plate 103.

As illustrated in FIGS. 2 to 4, the nip plate 103 is disposed above and in confrontation with the pressure roller 101 such that an inner peripheral surface of the fusing belt 105 is in sliding contact with the nip plate 103. The nip plate 103 is a plate-like member that receives radiant heat from the heater 102H and transmits the received heat to the fusing belt 105 and, eventually, to a developer image on a recording sheet SH. The nip plate 103 is formed by bending an aluminum plate, for example, having high thermal conductivity.

The reflection plate 104 surrounds the heater 102H and is spaced away from the heater 102H at a predetermined interval. The reflection plate 104 is adapted to reflect, toward the nip plate 103, radiant heat emitted from the heater 102H in a direction away from the nip plate 103. The reflection plate 104 is formed into a substantially U-shape in cross-section by bending an aluminum plate, for example, having high reflectance with respect to infrared or far-infrared rays.

The stay 106 has a substantially U-shaped cross-section in conformance with an outer shape of the reflection plate 104. The stay 106 is disposed so as to surround the reflection plate 104. The stay 106 supports front and rear end portions of the nip plate 103 through the reflection plate 104 for ensuring rigidity of the nip plate 103. The stay 106 is formed by bending a steel plate, for example, having rigidity higher than that of the nip plate 103.

As illustrated in FIGS. 2 and 3, the left and right guide members 110 integrally support left and right end portions of the respective heater 102H, nip plate 103, reflection plate 104, and stay 106. The guide members 110 are made of a thermally insulating material, such as resin.

The left guide member 110 is interposed between the liner guide portions 124A and 124B of the left side wall portion 122 in a state where the left guide member 110 is entered into the recessed portion 122A of the left side wall portion 122. Similarly, the right guide member 110 is interposed between the liner guide portions 124A and 124B of the right side wall portion 122 in a state where the right guide member 110 is entered into the recessed portion 122A of the right side wall portion 122. The left and right guide members 110 can be vertically linearly moved along the recessed portions 122A of the respective left and right side wall portions 122 while being guided by the linear guide portions 124A and 124B of the respective left and right side wall portions 122. The fusing belt 105, the heater 102H, the nip plate 103, the reflection plate 104, and the stay 106 can also be linearly moved toward and away from the pressure roller 101 in accordance with the linear movement of the left and right guide members 110, as illustrated in FIGS. 4 to 6.

In a state where the heating belt unit 102 is at a position illustrated in FIG. 4, the nip plate 103 and the fusing belt 105 are separated from the pressure roller 101. In a state where the heating belt unit 102 is at a position illustrated in FIG. 5, the nip plate 103 and the fusing belt 105 are in pressure contact with the pressure roller 101 so that a part of an outer peripheral surface of the pressure roller 101 is pressed and deformed. In a state where the heating belt unit 102 is at a position illustrated in FIG. 6, the nip plate 103 and the fusing belt 105 are in pressure contact with the pressure roller 101 so that a part of the outer peripheral surface of the pressure roller 101 is pressed and deformed further than in the state of FIG. 5.

The position of the heating belt unit 102 illustrated in FIG. 4 will be referred to as a separation position where the heating belt unit 102 is positioned away from the pressure roller 101. The position of the heating belt unit 102 illustrated in FIG. 6 will be referred to as a pressure contact position where the heating belt unit 102 is in pressure contact with the pressure roller 101. The pressure contact position is a position for fixing a developer image on the recording sheet SH of a type having a general thickness, such as a paper sheet, an OHP sheet, and the like. The position of the heating belt unit 102 illustrated in FIG. 5 will be referred to as a low-pressure contact position where the heating belt unit 102 is in pressure contact with the pressure roller 101 with a lower pressure force than that at the pressure contact position of FIG. 6. The low-pressure contact position is a position for fixing a developer image on the recording sheet SH of a type having a greater thickness than a general sheet, such as an envelope SH1.

Figure 5:
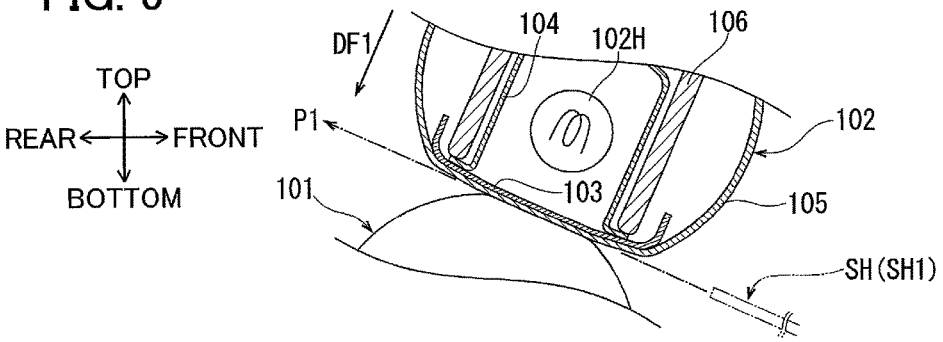
FIG. 5 is a schematic cross-sectional view of the fixing device according to the first embodiment, illustrating a state where the second fixing member is at a low-pressure contact position.
Figure 6:
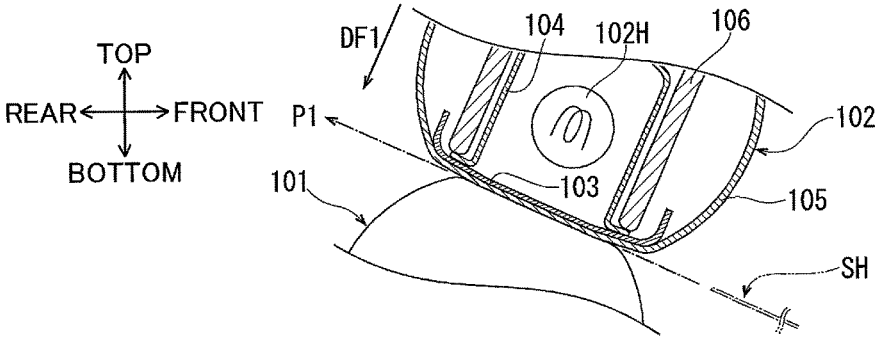
FIG. 6 is a schematic cross-sectional view of the fixing device according to the first embodiment, illustrating a state where the second fixing member is at a pressure contact position.

When the pressure roller 101 rotates in a state where the heating belt unit 102 is at the pressure contact position of FIG. 6 or at the low-pressure contact position of FIG. 5, the fusing belt 105 rotates following the rotation of the pressure roller 101, while contacting the pressure roller 101.

As illustrated in FIGS. 2 and 3, the left holding member 130 has a front end portion protruding downward and entering inside the holding-member support portion 125 of the left side wall portion 122. Similarly, the right holding member 130 has a front end portion protruding downward and entering inside the holding-member support portion 125 of the right side wall portion 122. The left and right holding members 130 are supported by the respective left and right holding-member support portions 125 so as to be pivotally movable about a pivot axis X130.

Each holding member 130 has a rear end portion that is bent into a substantially L-shape in cross-section. The L-shaped bent portion has a downward-facing surface serving as a contact surface 131A. Further, a hook 132 is formed at the rear end portion of each holding member 130.

Each holding member 130 has an engagement portion 133 positioned between the contact surface 131A and the pivot axis X130. The engagement portion 133 is in engagement with an upper end portion 111 of the guide member 110. Each guide member 110 has a pressed portion 112 in the vicinity of the upper end portion 111. The pressed portion 112 has a block shape that protrudes outward in the left-right direction. The engagement portion 133 has a lower edge that is in abutment with the pressed portion 112.

When the holding members 130 pivotally move in the clockwise direction in FIG. 3, the engagement portions 133 of the holding members 130 pull the upper end portions 111 of the guide members 110 upward, respectively. As a result, the heating belt unit 102 is displaced toward the separation position of FIG. 4.

On the other hand, when the holding members 130 pivotally move in the counterclockwise direction in FIG. 3, the lower edges of the engagement portions 133 of the holding members 130 push the pressed portions 112 of the guide members 110 downward, respectively. As a result, the heating belt unit 102 is displaced toward the low-pressure contact position of FIG. 5, and further displaced toward the pressure contact position of FIG. 6. That is, the holding members 130 hold the heating belt unit 102 such that the heating belt unit 102 can be displaced between the separation position illustrated in FIG. 4 and the pressure contact position illustrated in FIG. 6.

As illustrated in FIGS. 2 and 3, the left tension coil spring 109 has an upper end portion attached to the hook 132 of the left holding member 130, and a lower end portion attached to the hook 126 of the left side wall portion 122. Similarly, although illustrated is simplified in FIG. 2, the right tension coil spring 109 has an upper end portion attached to the hook 132 of the right holding member 130, and a lower end portion attached to the hook 126 of the right side wall portion 122.

Each tension coil spring 109 urges the heating belt unit 102 in an urging direction DF1 in which the heating belt unit 102 moves toward the pressure roller 101. The urging direction DF1 is a direction in which the holding member 130 moves toward a cam surface 155 of the corresponding cam member 150. The urging direction DF1 extends in a direction substantially parallel to a direction in which the recessed portion 122A of the side wall portion 122 is recessed. In other words, the urging direction DF1 is inclined downward and rearward.

Figure 7:
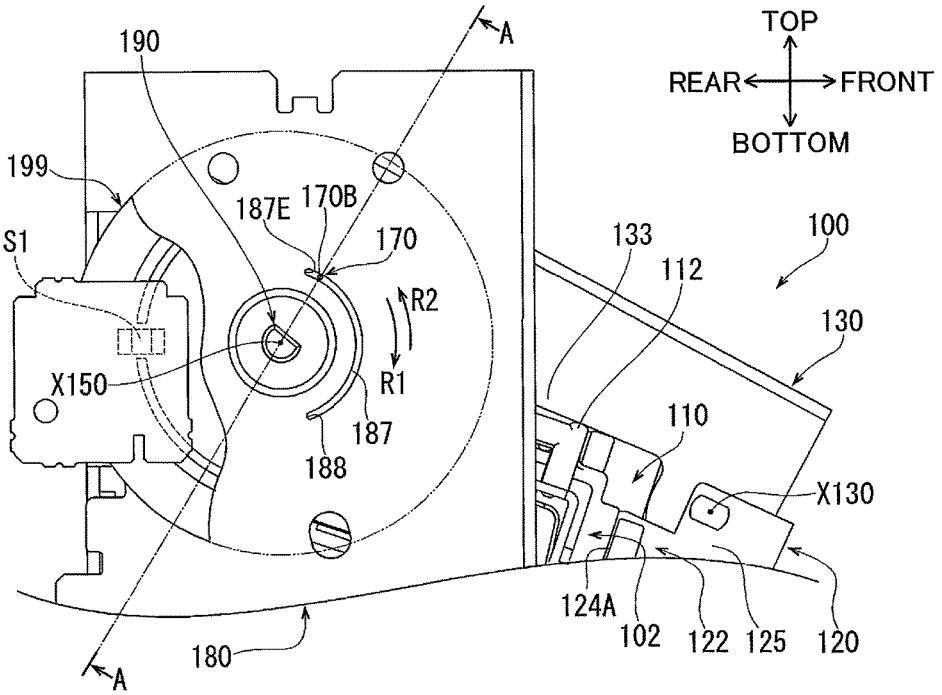
FIG. 7 is a side view of a cam member and a spring member of the fixing device, a regulating member, and a transmission gear provided in the image forming apparatus according to the first embodiment.
Figure 8:
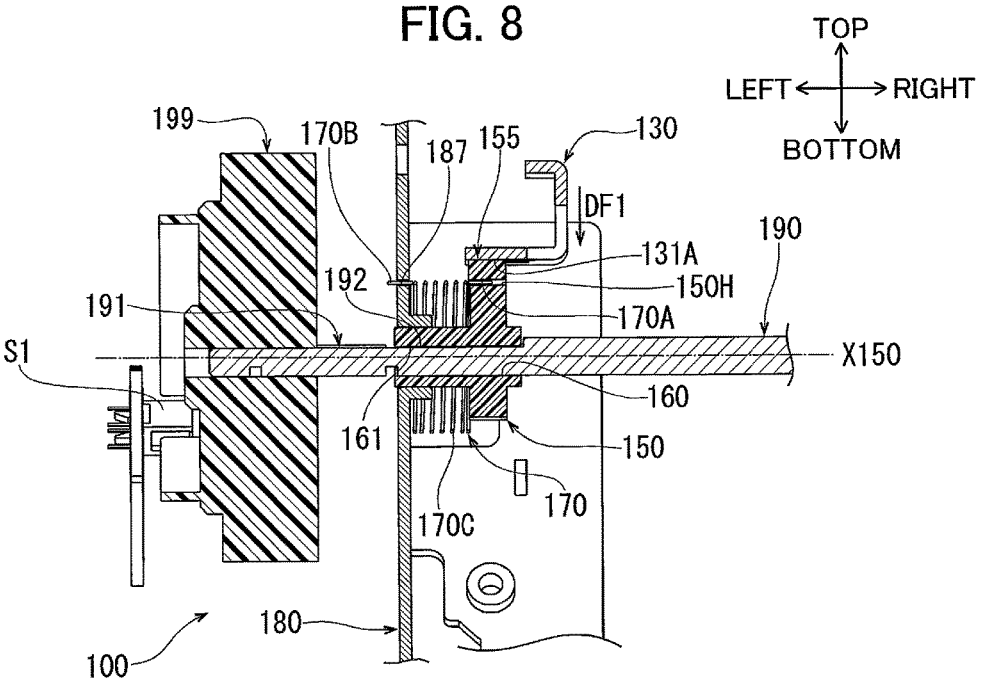
FIG. 8 is a partial cross-sectional view of FIG. 7, taken along a line A-A in FIG. 7.

As illustrated in FIG. 2, the transmission shaft 190 is provided at a position above upper-rear corner portions of the respective left and right side wall portions 122 and below the contact surfaces 131A of the respective left and right holding members 130. The transmission shaft 190 is rotatably supported at a pair of left and right regulating members 180 provided in the main body 2 as illustrated in FIGS. 7 and 8. Specifically, the left and right end portions of the transmission shaft 190 are respectively supported by the left and right regulating members 180 so that the transmission shaft 190 is rotatable about a rotation axis X150 extending in the left-right direction. Note that, in FIGS. 7 and 8, only the left regulating member 180 is illustrated. The left regulating member 180 and the right regulating member 180 are symmetrical in shape to each other. Therefore, illustration of the right regulating member 180 is omitted. Each regulating member 180 also functions as a side frame member in the main body 2. The regulating member 180 is a plate-shaped member formed of steel, for example, having high strength and rigidity. The regulating member 180 extends in the front-rear direction and the up-down direction.

As illustrated in FIGS. 7 and 8, the left shaft portion 191 of the transmission shaft 190 has a left end that protrudes further leftward from the left regulating member 180. The transmission gear 199 is coupled to this protruding end of the left shaft portion 191 so that the transmission shaft 190 is rotatable together with the transmission gear 199.

As illustrated in FIGS. 2 and 3, the left cam member 150 is attached to the left shaft portion 191 of the transmission shaft 190 so as to be rotatable together with the transmission shaft 190. Specifically, the left cam member 150 is fitted onto the left shaft portion 191 at a position immediately below the contact surface 131A of the left holding member 130. Similarly, the right cam member 150 is attached to the right shaft portion 191 of the transmission shaft 190 so as to be rotatable together with the transmission shaft 190. Specifically, the right cam member 150 is fitted onto the right shaft portion 191 at a position immediately below the contact surface 131A of the right holding member 130. As illustrated in FIG. 8, the left regulating member 180 is positioned between the left cam member 150 and the transmission gear 199.

When the motor M1 rotates in the normal rotation direction under the control of the controller C1, and the electromagnetic clutch GC1 is switched to the connecting state under the control of the controller C1, the transmission section G1 transmits the driving force of the motor M1 to the cam members 150 to rotate the cam members 150 about the rotation axis X150 in a first direction R1.

On the other hand, when the motor M1 rotates in the reverse rotation direction under the control of the controller C1, and the electromagnetic clutch GC1 is switched to the connecting state under the control of the controller C1, the transmission section G1 transmits the driving force of the motor M1 to the cam members 150 to rotate the cam members 150 about the rotation axis X150 in a second direction R2 which is opposite to the first direction R1.

Specifically, the first direction R1 is a clockwise direction in FIG. 3, while the second direction R2 is a counterclockwise direction in FIG. 3.

As illustrated in FIGS. 9 to 17, each cam member 150 includes a cam surface 155 and a non-used surface 159. The cam surface 155 is a part of a peripheral surface of the cam member 150 that can contact the contact surface 131A of the corresponding holding member 130. When viewed along the rotation axis X150, the contact surface 131A of the holding member 130 with which the corresponding cam surface 155 is in contact linearly extends so as to be inclined upward and rearward.

The cam surface 155 is configured such that a distance between the cam surface 155 and the rotation axis X150 is reduced in the second direction R2. Here, the configuration of "a distance between the cam surface 155 and the rotation axis X150 is reduced in the second direction R2" includes a configuration where the cam surface 155 has a portion to which a distance from the rotation axis X150 is uniform and the portion extends about the rotation axis X150 with a certain length. However, a configuration where the cam surface 155 has a portion to which a distance from the rotation axis X150 is increased in the second direction R2 is not regarded as the configuration of "a distance between the cam surface 155 and the rotation axis X150 is reduced in the second direction R2".

The non-used surface 159 is a remaining part of the peripheral surface and is positioned between one and the other ends of the cam surface 155. The non-used surface 159 substantially linearly extends between the one end and the other end of the cam surface 155. The controller C1 controls the motor M1 and the electromagnetic clutch GC1 to rotate the cam members 150 in the first direction R1 and the second direction R2 as long as the non-used surfaces 159 of the cam members 150 do not contact the contact surfaces 131A of the corresponding holding members 130.

Figure 10:
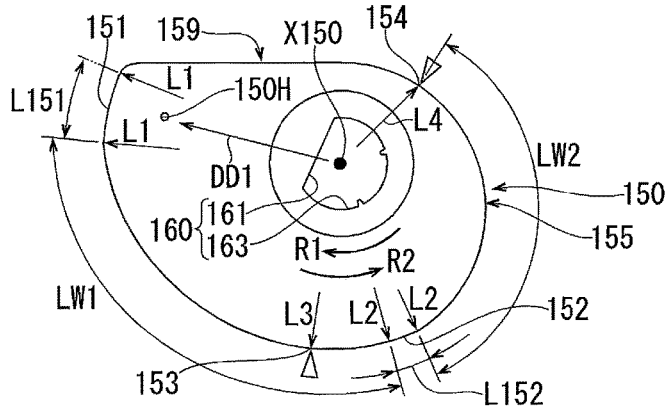
FIG. 10 is a side view of the cam member according to the first embodiment.

As illustrated in FIG. 10, the cam surface 155 includes a first part 151, a second part 152, a third part 153, and a fourth part 154. The fourth part 154 is an example of a prescribed part.

The first part 151 is provided such that a distance between the first part 151 and the rotation axis X150 is set to a first distance L1 that is the largest distance between the rotation axis X150 and the cam surface 155. The first part 151 extends about the rotation axis X150 by a predetermined length L151 while maintaining the first distance L1 from the rotation axis X150. A connection portion between the first part 151 and the non-used surface 159 is rounded.

The second part 152 is provided at a position away from the first part 151 about the rotation axis X150 by a predetermined distance in the second direction R2. A distance between the second part 152 and the rotation axis X150 is set to a second distance L2 that is smaller than the first distance L1. The second part 152 extends about the rotation axis X150 by a predetermined length L152 while maintaining the second distance L2 from the rotation axis X150.

The third part 153 is provided at a position away from the second part 152 in the first direction R1 by a predetermined distance about the rotation axis X150. A distance between the third part 153 and the rotation axis X150 is set to a third distance L3 that is larger than the second distance L2.

The fourth part 154 is provided at a position away from the second part 152 in the second direction R2 by a predetermined distance about the rotation axis X150. A distance between the fourth part 154 and the rotation axis X150 is set to a fourth distance L4 that is smaller than the second distance L2.

A part of the cam surface 155 extending from the first part 151 to the third part 153 is gently curved, with the distance from the rotation axis X150 being gradually reduced in the second direction R2. Further, a part of the cam surface 155 extending from the third part 153 to the second part 152 is gently curved, with the distance from the rotation axis X150 being gradually reduced in the second direction R2. Further, a part of the cam surface 155 extending from the second part 152 to the fourth part 154 is gently curved, with the distance from the rotation axis X150 being gradually reduced in the second direction R2.

In the cam surface 155, a length LW1 between the first part 151 and the second part 152 is set greater than a length LW2 between the second part 152 and the fourth part 154.

Figure 9:
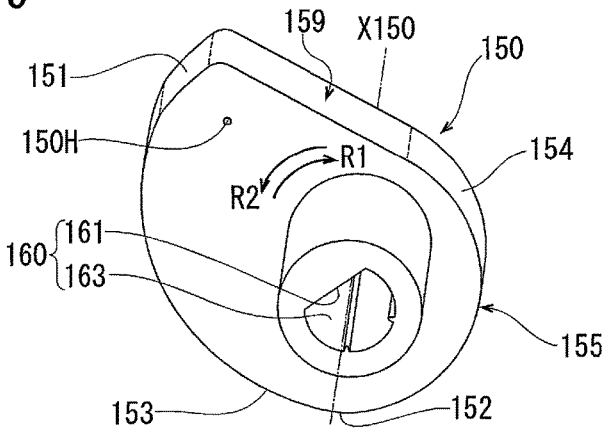
FIG. 9 is a perspective view of the cam member according to the first embodiment.

As illustrated in FIGS. 9 and 10, a shaft hole 160 is formed in each cam member 150. The shaft hole 160 is centered on the rotation axis X150. In other words, the shaft hole 160 is coaxial with the rotation axis X150. The shaft hole 160 has an arcuate surface portion 163 and a first flat surface portion 161 cutting away a part of a cylindrical surface to provide a substantially D-shape in cross-section. As illustrated in FIG. 10, the first flat surface portion 161 is positioned so as to cross a direction DD1 directing from the rotation axis X150 toward the first part 151.

As illustrated in FIGS. 2, 3, and 8, the shaft portions 191 of the transmission shaft 190 are fitted into the shaft holes 160 of the respective cam members 150 to provide fitting portions therebetween. Each shaft portion 191 of the transmission shaft 190 has a substantially D-shaped cross-section conforming to the shape of the shaft hole 160 of the cam member 150. The shaft portions 191 of the transmission shaft 190 each have a second flat surface 192 in abutment with the corresponding first flat surface portion 161.

As illustrated in FIGS. 2, 3, 7, and 8, the fixing device 100 further includes two spring members 170. One of the spring members 170 is disposed between the left cam member 150 and the left regulating member 180, while remaining one of the spring members 170 is disposed between the right cam member 150 and the right regulating member 180. Hereinafter, a detailed description will be given only of the spring member 170 disposed between the left cam member 150 and the left regulating member 180, and the spring member 170 disposed between the right cam member 150 and the right regulating member 180 is not particularly illustrated or described since the spring members 170 have the same configuration.

The spring member 170 is formed by bending a wire made of metal having excellent resilient deformation characteristics, for example. As illustrated in FIGS. 2 and 8, the spring member 170 includes one end portion 170A, the other end portion 170B, and a coil portion 170C. The other end portion 170B is an example of another end portion. The coil portion 170C is in the form of a coil through which the rotation axis X150 extends. The one end portion 170A is bent at a right end of the coil portion 170C and protrudes rightward. The other end portion 170B is bent at a left end of the coil portion 170C and protrudes leftward.

As illustrated in FIGS. 8 to 10, the cam member 150 has an insertion hole 150H extending in a direction parallel to the rotation axis X150. The insertion hole 150H is positioned between the rotation axis X150 and the first part 151 of the cam member 150. The insertion hole 150H has an inner diameter slightly greater than an outer diameter of the one end portion 170A of the spring member 170.

As illustrated in FIG. 8, the one end portion 170A of the spring member 170 is inserted into the insertion hole 150H of the cam member 150. Hence, the spring member 170 is connected to the cam member 150 in a state where the one end portion 170A of the spring member 170 is positioned between the rotation axis X150 and the first part 151 of the cam member 150. That is, the one end portion 170A of the spring member 170 is directly disposed in the cam member 150. The one end portion 170A of the spring member 170 can be displaced so as to depict an arc-shaped locus about the rotation axis X150 in interlocking relation with the left cam member 150 rotating about the rotation axis X.

As illustrated in FIG. 7, the regulating member 180 includes a guide portion 187 and an abutment portion 188. The guide portion 187 and the abutment portion 188 are provided for regulating movement of the other end portion 170B of the spring member 170. The guide portion 187 is an arcuate-shaped groove centered on the rotation axis X150. The abutment portion 188 is provided at a downstream end portion of the guide portion 187 in the first direction R1.

As illustrated in FIGS. 7 and 8, the guide portion 187 has a groove width slightly greater than an outer diameter of the other end portion 170B of the spring member 170. The other end portion 170B of the spring member 170 is inserted into the guide portion 187. The guide portion 187 guides the other end portion 170B of the spring member 170 such that the other end portion 170B draws an arc-shaped locus about the rotation axis X150.

Figure 11:
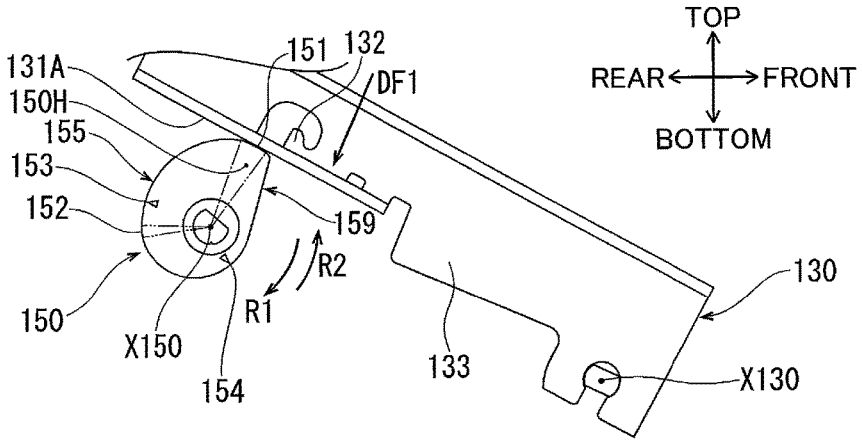
FIG. 11 is a partial side view for description how the cam member acts on a holding member of the fixing device according to the first embodiment, illustrating a state where the cam member is at an original position.

The position of the other end portion 170B of the spring member 170 illustrated in FIG. 7 corresponds to a state where the cam member 150 is at the position illustrated in FIG. 11, i.e., a state where the first part 151 of the cam member 150 is in contact with the contact surface 131A of the holding member 130. In this state, a downstream end portion 187E of the guide portion 187 in the second direction R2 is separated from the other end portion 170B of the spring member 170 in the second direction R2. Further, in this state, the one end portion 170A of the spring member 170 overlaps with the other end portion 170B of the spring member 170 when viewed along the rotation axis X150.

The abutment portion 188 is configured to allow the other end portion 170B of the spring member 170 to about on the abutment portion 188 while the other end portion 170B is guided by the guide portion 187 to be displaced in the first direction R1.

As described below in detail, the controller C1 controls the motor M1 to rotate the cam members 150 in the first direction R1. Rotation of the cam members 150 in the first direction R1 causes the cam surfaces 155 to be moved away from the corresponding contact surfaces 131A of the holding members 130. As a result, the heating belt unit 102 urged by the tension coil springs 109 is displaced to the pressure contact position of FIG. 6. On the other hand, the controller C1 controls the motor M1 to rotate the cam members 150 in the second direction R2. Rotation of the cam members 150 in the second direction R2 brings the cam surfaces 155 into contact with the corresponding contact surfaces 131A of the holding members 130. As a result, the heating belt unit 102 is displaced to the separation position of FIG. 4 against the urging force of the tension coil springs 109.

As illustrated in FIGS. 7, and 8, the photointerrupter S1 is connected to the controller C1. The controller C1 is configured to detect a rotational posture of the transmission gear 199 through the photointerrupter S1, thereby detecting whether or not the cam members 150 are at a position illustrated in FIG. 11, that is, whether or not the heating belt unit 102 is at the separation position illustrated in FIG. 4.

Further, the controller C1 is configured to control the motor M1 as a stepping motor to rotate accurately in the normal rotation direction and the reverse rotation direction under pulse signal control or the like with the position of the cam members 150 illustrated in FIG. 11 as an original position, thereby accurately changing the rotational posture of the cam members 150. When displacing the cam members 150 from the original position illustrated in FIG. 11 toward the position illustrated in FIG. 17, the controller C1 causes the cam members 150 to rotate in the first direction R1. When returning the cam members 150 to the original position illustrated in FIG. 11, the controller C1 causes the cam members 150 to rotate in the second direction R2.

In a state where the first parts 151 of the cam surfaces 155 are in contact with the contact surfaces 131A of the corresponding holding members 130, the cam members 150 allow the heating belt unit 102 to be displaced to the separation position of FIG. 4 against the urging force of the tension coil springs 109 as illustrated in FIGS. 2, 3, and 11, since the first distance L1 is the largest distance between the rotation axis X150 and the cam surface 155.

Figure 12:
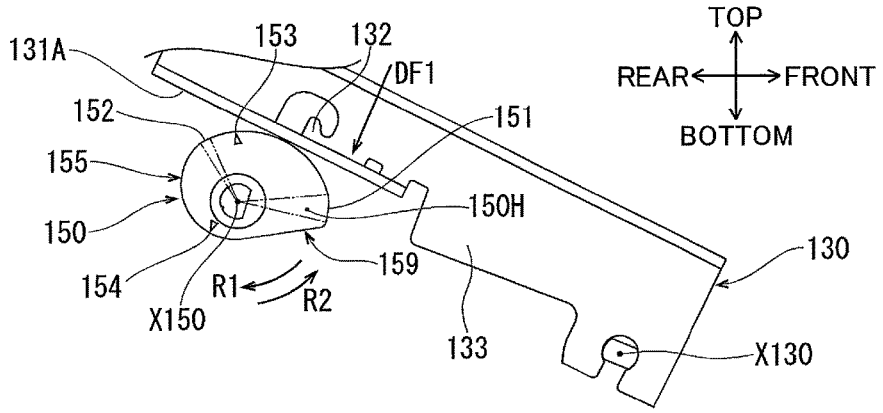
FIG. 12 is a partial side view for description how the cam member acts on the holding member according to the first embodiment, illustrating a state where the cam member rotates in a first direction from the position illustrated in FIG. 11.
Figure 13:
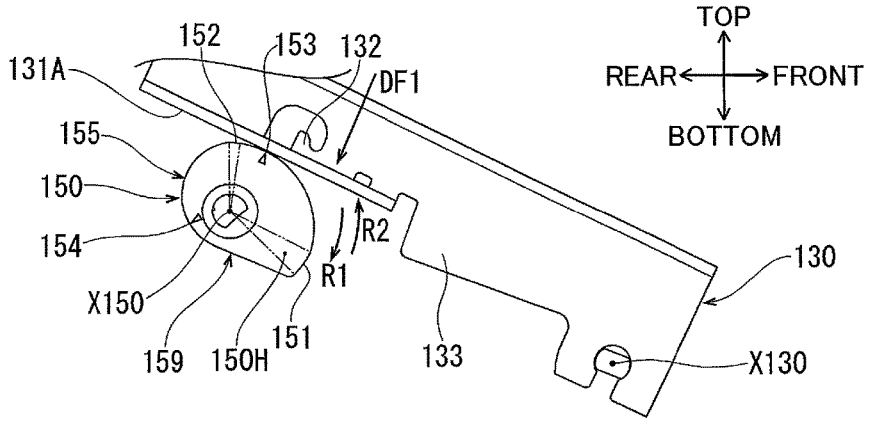
FIG. 13 is a partial side view for description how the cam member acts on the holding member according to the first embodiment, illustrating a state where the cam member further rotates in the first direction from the position illustrated in FIG. 12.

As illustrated in FIGS. 12 and 13, when the controller C1 controls the motor M1 to start rotating the cam members 150 in the first direction R1, the part between the first part 151 and the second part 152 in each cam surface 155 is brought into contact with the corresponding contact surface 131A of the holding member 130. This part has a gently curved surface in which the distance from the rotation axis X150 is gradually reduced in the second direction R2. Hence, each of the holding members 130 is gradually pivotally moved in the urging direction DF1 and, thus, the heating belt unit 102 moves toward the pressure roller 101. Then, as illustrated in FIG. 13, at a timing at which the third part 153 of each cam surface 155 contacts the corresponding contact surface 131A of the holding member 130, the heating belt unit 102 is brought into contact with the pressure roller 101.

Figure 14:
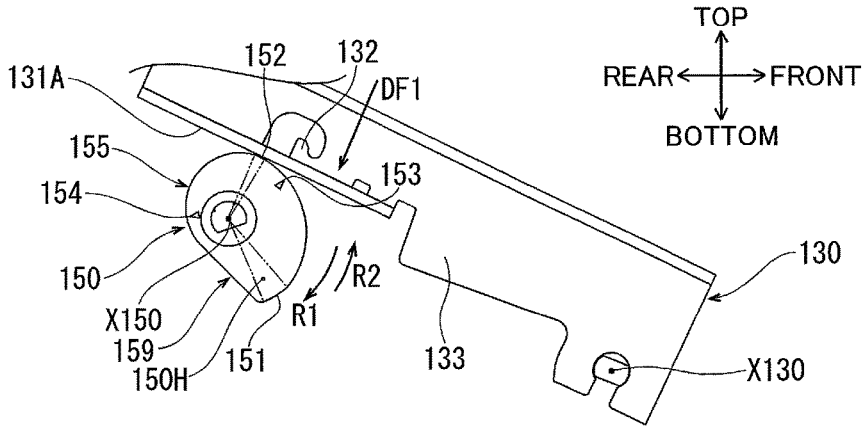
FIG. 14 is a partial side view for description how the cam member acts on the holding member according to the first embodiment, illustrating a state where the cam member further rotates in the first direction from the position illustrated in FIG. 13 to provide the low-pressure contact position of the second fixing member.

As illustrated in FIG. 14, when the controller C1 causes the cam members 150 to further rotate in the first direction R1, the second part 152 of each cam surface 155 is brought into contact with the corresponding contact surface 131A of the holding member 130. In this state, each of the holding members 130 is further pivotally moved in the urging direction DF1, and the heating belt unit 102 is displaced to the low-pressure contact position of FIG. 5 while pressing and deforming a part of the outer peripheral surface of the pressure roller 101.

Figure 15:
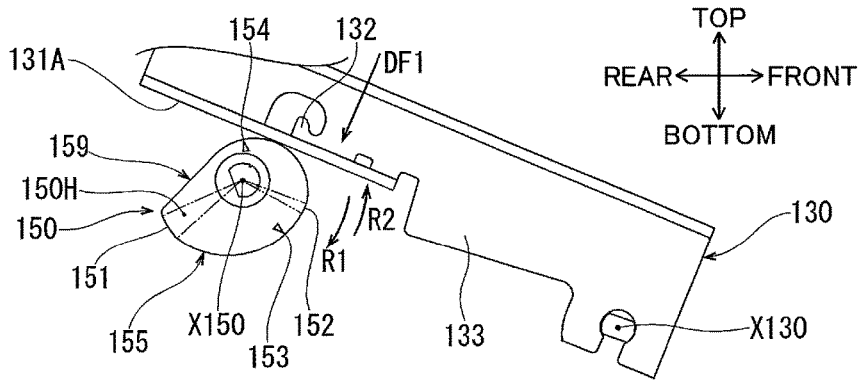
FIG. 15 is a partial side view for description how the cam member acts on the holding member according to the first embodiment, illustrating a state where the cam member further rotates in the first direction from the position illustrated in FIG. 14.
Figure 16:
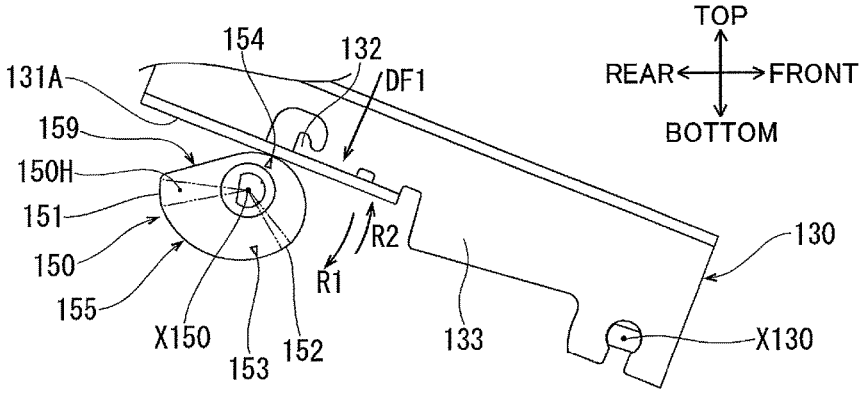
FIG. 16 is a partial side view for description how the cam member acts on the holding member according to the first embodiment, illustrating a state where the cam member further rotates in the first direction from the position illustrated in FIG. 15.

As illustrated in FIGS. 15 and 16, when the controller C1 causes the cam members 150 to further rotate in the first direction R1, the part between the second part 152 and the fourth part 154 in each cam surface 155 is brought into contact with the corresponding contact surface 131A of the holding member 130. This part has a gently curved surface in which the distance from the rotation axis X150 is gradually reduced in the second direction R2. Hence, each of the holding members 130 is gradually pivotally moved in the urging direction DF1, and thus, the heating belt unit 102 further presses and deforms a part of the outer peripheral surface of the pressure roller 101.

Then, as illustrated in FIG. 16, when the fourth part 154 of each cam surface 155 moves to a position opposed to the corresponding contact surface 131A of the holding member 130, the cam surface 155 of each cam member 150 separates from the corresponding contact surface 131A. In other words, a contact timing of the heating belt unit 102 with the pressure roller 101 is set earlier than a separation timing of the cam surfaces 155 of the cam members 150 rotating in the first direction R1 from the corresponding contact surfaces 131A of the holding members 130. Note that, in the state illustrated in FIG. 16, a minute gap is formed between the fourth part 154 and the contact surface 131A. When each of the cam members 150 further rotate in the first direction R1, the gap between the cam surface 155 and the corresponding contact surface 131A increases.

Figure 17:
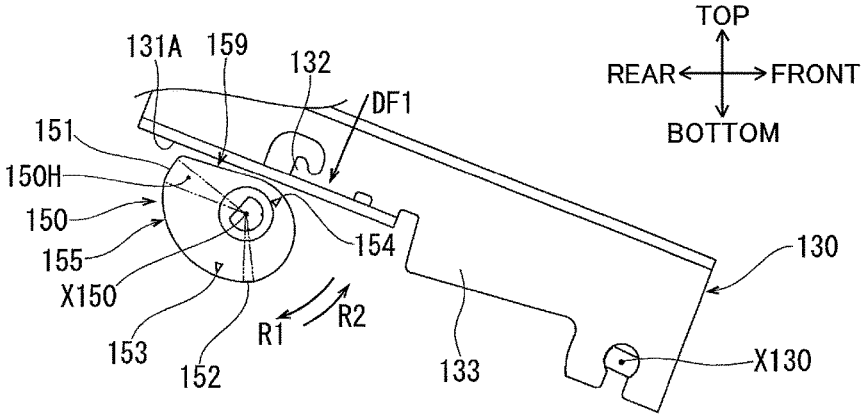
FIG. 17 is a partial side view for description how the cam member acts on the holding member according to the first embodiment, illustrating a state where the cam member further rotates in the first direction from the position illustrated in FIG. 16 to provide the pressure contact position of the second fixing member.

As illustrated in FIG. 17, when the controller C1 causes the cam members 150 to further rotate in the first direction R1, the non-used surface 159 of each cam member 150 is opposed to the corresponding contact surface 131A of the holding member 130 with a gap therebetween. As a result, only the urging force of the tension coil springs 109 acts on the respective holding members 130 to displace the heating belt unit 102 to the pressure contact position of FIG. 6.

When the controller C1 controls the motor M1 to rotate the cam members 150 in the second direction R2, the cam members 150 rotate in the second direction R2 by performing the operation to rotate the cam members 150 in the first direction R1 described above in reverse, and accordingly, the holding members 130 are pivotally moved by performing the operation to pivotally move the holding members 130 in the urging direction DF1 described above in reverse. As a result, the heating belt unit 102 is displaced from the pressure contact position of FIG. 6 to the separation position of FIG. 4.

The controller C1 causes the heating belt unit 102 to be displaced among the separation position of FIG. 4, the low-pressure contact position of FIG. 5, and the pressure contact position of FIG. 6 depending on the state of the image forming apparatus 1 or in response to an instruction from the image forming apparatus 1.

For example, in a case where the type of the recording sheet SH is a paper sheet, the controller C1 causes the heating belt unit 102 to be displaced to the pressure contact position of FIG. 6. In a case where the recording sheet SH is an envelope, the controller C1 causes the heating belt unit 102 to be displaced to the low-pressure contact position of FIG. 5. This enables the fixing device 100 to perform an adequate thermal-fixing process according to the thickness of the recording sheet SH.

Further, for example, when the image forming apparatus 1 shifts to a sleep mode, the controller C1 causes the heating belt unit 102 to be displaced to the separation position of FIG. 4. Then, the heating belt unit 102 is displaced to the low-pressure contact position of FIG. 5 or the pressure contact position of FIG. 6 immediately before the image forming apparatus 1 starts its image forming operation. This can reduce a time period during which the pressure roller 101 is locally pressurized and heated. Thus, quality in the thermal-fixing process can be maintained. Further, improvement in durability of the fixing device 100 can be achieved.

Figure 18:
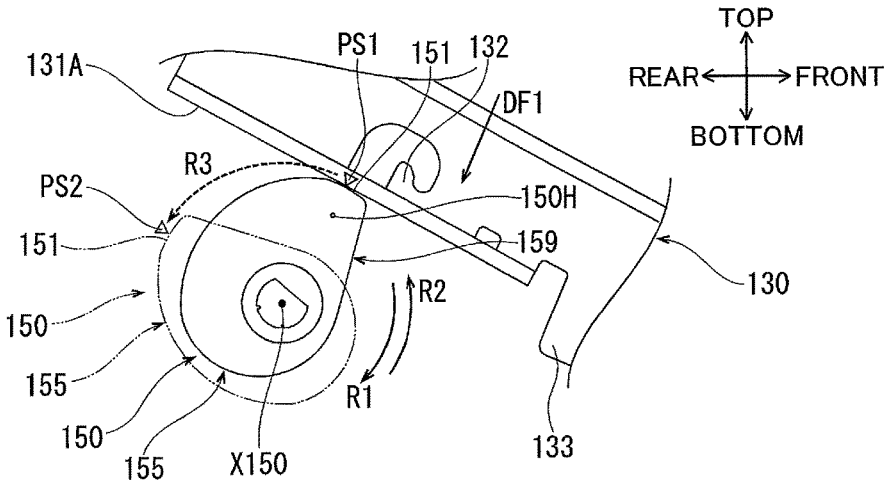
FIG. 18 is a partial side view for description of the first direction of the cam member according to the first embodiment.

The postures of the cam member 150 and the holding member 130 denoted by solid lines in FIG. 18 are the same as those illustrated in FIG. 11 and correspond to a state where the heating belt unit 102 is displaced to the separation position of FIG. 4. The posture of the cam member 150 denoted by a dashed double-dotted line in FIG. 18 is the same as that illustrated in FIG. 17 and corresponds to a state where the heating belt unit 102 is displaced to the pressure contact position of FIG. 6.

As illustrated in FIG. 18, in a state where the heating belt unit 102 is displaced to the separation position of FIG. 4, the first part 151 of the cam member 150 is in contact with the contact surface 131A of the holding member 130 at a first position PS1.

Further, in a state where the heating belt unit 102 is displaced to the pressure contact position of FIG. 6, the first part 151 of the cam member 150 is positioned away from the contact surface 131A of the holding member 130 at a second position PS2.

Here, a direction R3 is defined as a direction in which the first part 151 rotates about the rotation axis X150 from the first position PS1 to the second position PS2 with the minimum distance. In other words, the direction R3 is a direction from the first position PS1 to the second position PS2 about the rotation axis X150 with the smaller central angle. The direction R3 is the same direction as the second direction R2. The first direction R1 is a direction opposite to the direction R3.

Setting the first direction R1 as the direction opposite to the direction R3 allows the cam members 150 to rotate with a comparatively long distance for displacement of the heating belt unit 102 between the pressure contact position of FIG. 6 and the separation position of FIG. 4. Hence, a range of displacement of the contacting position between the contact surface 131A of the holding member 130 and the cam surface 155 relative to the rotation axis X150 can be reduced.

As a result, the image forming apparatus 1 can obviate abrupt change in the direction in which the urging force of the tension coil springs 109 causes the cam members 150 to rotate about the rotation axis X150 from the first direction R1 to the second direction R2 or from the second direction R2 to the first direction R1 due to a change in the rotational posture of the cam members 150. Consequently, collision of components constituting the transmission section G1 can be restrained. Specifically, at the fitting portions between the shaft portions 191 of the transmission shaft 190 and the corresponding shaft holes 160 of the cam members 150 and at a fitting portion between the shaft portion 191 of the transmission shaft 190 and the transmission gear 199 (see FIGS. 2 and 8), the mutually-fitted components can be prevented from colliding with each other due to sudden elimination of a gap between the mutually-fitted components.

Figure 19:
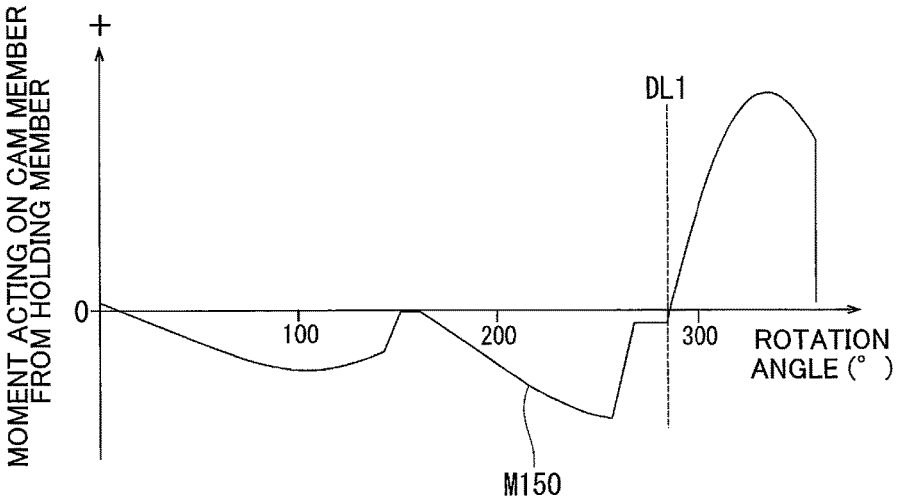
FIG. 19 is a graphical representation showing a relationship between a rotation angle of the cam member and a moment acting on the cam member from the holding member according to the first embodiment.

In a graph illustrated in FIG. 19, a state where a rotation angle of the cam member 150 is at or near 0 degrees (origin) corresponds to a state where the heating belt unit 102 is displaced to the pressure contact position of FIG. 6, and a state where the rotation angle of the cam member 150 approaches an angle indicated by a dashed line DL1 corresponds to a state where the heating belt unit 102 is displaced to the separation position of FIG. 4. In this graph, a reaction force from the pressure roller 101 whose outer peripheral surface is partially pressed and deformed by the heating belt unit 102 is not taken into consideration.

When the cam member 150 rotates in the first direction R1, a reaction force acts on the cam surface 155 from the corresponding contact surface 131A of the holding member 130 urged by the tension coil spring 109, with the result that a rotational moment M150 about the rotation axis X150 acts on the cam member 150. When the rotation angle of the cam member 150 exceeds the angle indicated by the dashed line DL1, the direction of the rotational moment M150 is abruptly reversed. In the present embodiment, the cam member 150 rotates in the first direction R1 and the second direction R2 as long as the non-used surface 159 is out of contact with the corresponding contact surface 131A of the holding member 130. Thus, the rotation angle of the cam member 150 does not exceed the angle indicated by the dashed line DL1. That is, the controller C1 can suppress the cam member 150 rotating by the urging force of the tension coil spring 109 from abruptly changing its rotating direction from the first direction R1 to the second direction R2 or from the second direction R2 to the first direction R1 due to a change in the rotational posture of the cam member 150.

<Operations of Spring Member and Regulating Member in accordance with Rotation of Cam Member>

As illustrated in FIGS. 20A to 20G, when the cam member 150 rotates in the first direction R1 and the second direction R2, the one end portion 170A and the other end portion 170B of the corresponding spring member 170 are moved and the guide portion 187 and the abutment portion 188 of the corresponding regulating member 180 regulate movement of the other end portion 170B of the spring member 170.

In FIGS. 20A to 20G, the cam member 150 and the one end portion 170A of the spring member 170 are positioned further rightward of the regulating member 180 including the guide portion 187 and the abutment portion 188 and are denoted by dashed lines.

Figures 20A, 20B, 20C, 20D, 20E, 20F, 20G:
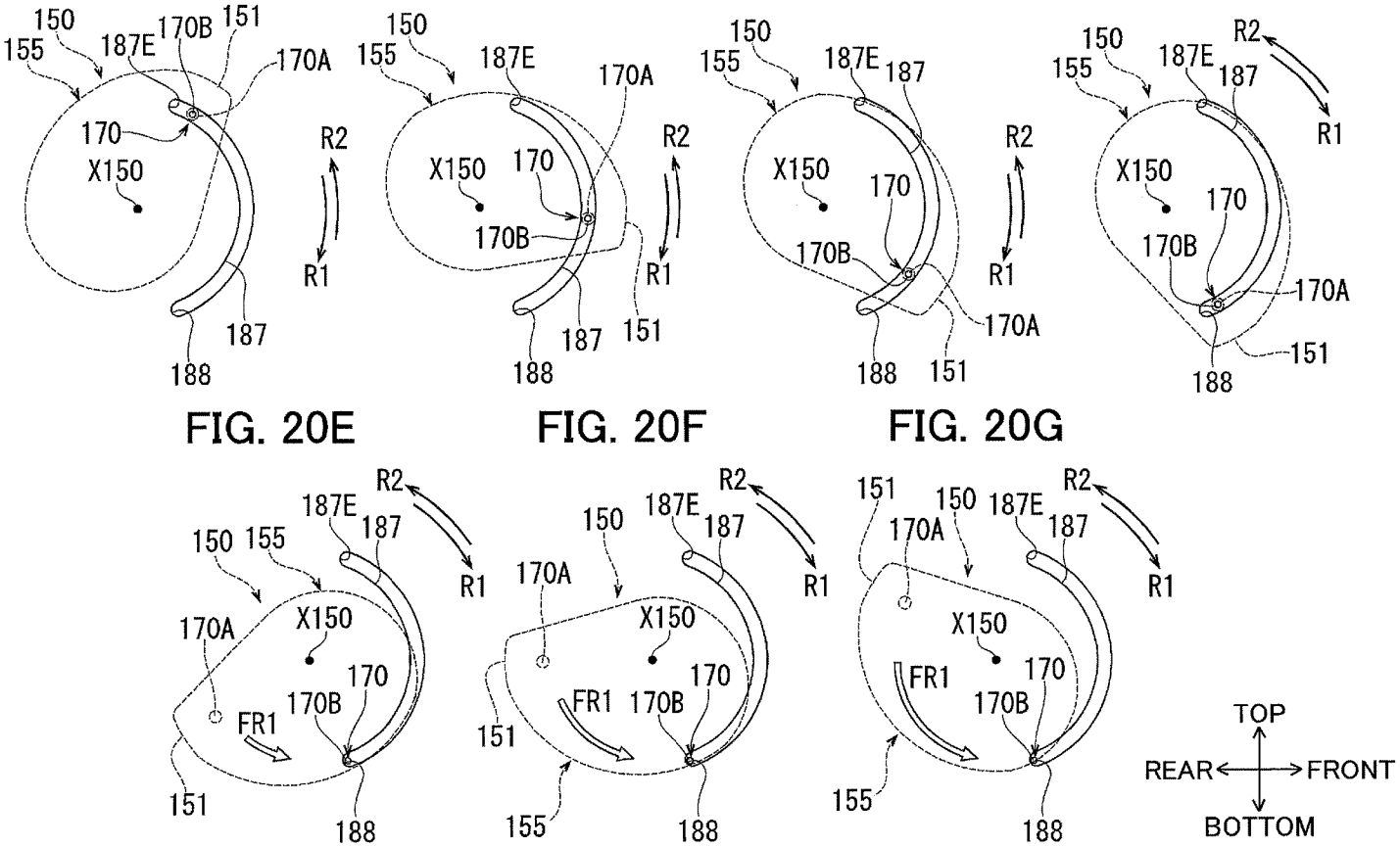
FIG. 20A is a schematic side view for description how the spring member and the regulating member operate in accordance with rotation of the cam member according to the first embodiment, illustrating a state where the cam member is at a position corresponding to that in FIG. 11.
FIG. 20B is a schematic side view for description how the spring member and the regulating member operate in accordance with rotation of the cam member according to the first embodiment, illustrating a state where the cam member rotates in the first direction from a position illustrated in FIG. 20A and where the cam member is at a position corresponding to that in FIG. 12.
FIG. 20C is a schematic side view for description how the spring member and the regulating member operate in accordance with rotation of the cam member according to the first embodiment, illustrating a state where the cam member further rotates in the first direction from a position illustrated in FIG. 20B and where the cam member is at a position corresponding to that in FIG. 13.
FIG. 20D is a schematic side view for description how the spring member and the regulating member operate in accordance with rotation of the cam member according to the first embodiment, illustrating a state where the cam member further rotates in the first direction from a position illustrated in FIG. 20C and where the cam member is at a position corresponding to that in FIG. 14.
FIG. 20E is a schematic side view for description how the spring member and the regulating member operate in accordance with rotation of the cam member according to the first embodiment, illustrating a state where the cam member further rotates in the first direction from a position illustrated in FIG. 20D and where the cam member is at a position corresponding to that in FIG. 15.
FIG. 20F is a schematic side view for description how the spring member and the regulating member operate in accordance with rotation of the cam member according to the first embodiment, illustrating a state where the cam member further rotates in the first direction from a position illustrated in FIG. 20E and where the cam member is at a position corresponding to that in FIG. 16.
FIG. 20G is a schematic side view for description how the spring member and the regulating member operate in accordance with rotation of the cam member according to the first embodiment, illustrating a state where the cam member further rotates in the first direction from a position illustrated in FIG. 20F and where the cam member is at a position corresponding to that in FIG. 17.

Note that the position of the cam member 150 and the positions of the respective one and the other end portions 170A and 170B of the spring member 170 illustrated in FIG. 20A correspond to those in FIG. 11. Similarly, FIG. 20B corresponds to FIG. 12; FIG. 20C corresponds to FIG. 13; FIG. 20D corresponds to FIG. 14; FIG. 20E corresponds to FIG. 15; FIG. 20F corresponds to FIG. 16; and FIG. 20G corresponds to FIG. 17.

When the cam member 150 rotates in the first direction R1 from the position illustrated in FIG. 11, the one end portion 170A and the other end portion 170B of the spring member 170 also moves in the first direction R1 while overlapping each other when viewed along the rotation axis X150, as illustrated in FIGS. 20A to 20D.

When the cam member 150 further rotates in the first direction R1, the other end portion 170B of the spring member 170 abuts on the abutment portion 188 at a timing between the state illustrated in FIG. 20D and the state illustrated in FIG. 20E. The abutment portion 188 restricts the other end portion 170B from moving further in the first direction R1. As a result, as illustrated in FIGS. 20E to 20G, only the one end portion 170A of the spring member 170 moves in the first direction R1. This increases a gap between the one end portion 170A and the other end portion 170B, so that the spring member 170 suppresses the cam member 150 from rotating in the first direction R1 while storing a restoring force FR1. The restoring force FR1 of the spring member 170 becomes maximum in the state illustrated in FIG. 20G.

The other end portion 170B of the spring member 170 abuts on the abutment portion 188 after the state illustrated in FIG. 14 to which FIG. 20D corresponds. That is, the other end portion 170B of the spring member 170 abuts on the abutment portion 188 after the heating belt unit 102 is brought into contact with the pressure roller 101 by the cam member 150 rotating in the first direction R1 and the second part 152 moves past the contact surface 131A of the holding member 130. Here, the phrase "the second part 152 moves past the contact surface 131A" implies that, during the rotation of the cam member 150 in the first direction R1, the second part 152 contacts the contact surface 131A, and then, separates from the contact surface 131A.

Further, the other end portion 170B of the spring member 170 abuts on the abutment portion 188 before the state illustrated in FIG. 15 to which FIG. 20E corresponds. That is, the other end portion 170B of the spring member 170 abuts on the abutment portion 188 before separation of the fourth part 154 of the cam member 150 rotating in the first direction R1 from the contact surface 131A of the holding member 130.

When the cam member 150 rotates in the second direction R2 from the position illustrated in FIG. 17, only the one end portion 170A of the spring member 170 moves in the second direction R2 as sequentially illustrated in FIGS. 20G, 20F, and 20E in this order while the other end portion 170B of the spring member 170 is in abutment with the abutment portion 188. This reduces the gap between the one end portion 170A and the other end portion 170B, so that the spring member 170 facilitates rotation of the cam member 150 in the first direction R1 while releasing its restoring force FR1.

When the cam member 150 further rotates in the second direction R2, the other end portion 170B of the spring member 170 separates from the abutment portion 188 at a timing between the state illustrated in FIG. 20E and the state illustrated in FIG. 20D, so that the restoring force FR1 becomes zero. Then, as sequentially illustrated in FIGS. 20D, 20C, 20B and 20A in this order, the one end portion 170A and the other end portion 170B of the spring member 170 moves in the second direction R2 while overlapping each other when viewed along the rotation axis X150.

Advantageous Effects

In the image forming apparatus 1 according to the first embodiment, a gap between the components constituting the transmission section G1 can be reduced by the spring member 170 whose restoring force FR1 is applied to the corresponding cam member 150 as described above in accordance with the rotation of the cam member 150 in the first and second directions R1 and R2 as illustrated in FIGS. 20A to 20G. Hence the components constituting the transmission section G1 can be suppressed from colliding with each other due to sudden elimination of the gap.

For example, at the fitting portion between the shaft portion 191 of the transmission shaft 190 and the corresponding shaft hole 160 of the cam member 150 and at the fitting portion between the shaft portion 191 of the transmission shaft 190 and the transmission gear 199 (see FIGS. 2 and 8), the components to be mutually fitted can be prevented from colliding with each other due to sudden elimination of the gap between the mutually-fitted components.

Specifically, when the cam member 150 rotates in the first direction R1, the spring member 170 stores the restoring force FR1 by the rotation of the cam member 150. Hence, the cam member 150 is suppressed from rotating in the first direction R1 by the urging force of the spring member 170. This suppresses sudden rotation of the cam member 150 in the first direction R1, thereby reducing generation of collision noise between the components constituting the transmission section G1. Further, when the cam member 150 rotates in the second direction R2, the spring member 170 releases its restoring force FR1 by the rotation of the cam member 150. Hence, the urging force of the spring member 170 facilitates rotation of the cam member 150 in the second direction R2. This suppresses sudden rotation of the cam members 150 in the second direction R2, thereby reducing generation of collision noise between the components constituting the transmission section G1.

Thus, in the image forming apparatus 1 according to the first embodiment, generation of abnormal noise can be suppressed.

Further, in the image forming apparatus 1, as illustrated in FIGS. 2 and 8, the coil portion 170C in a form of coil through which the rotation axis X150 extends is provided between the one end portion 170A and the other end portion 170B of the spring member 170. This can simplify the configuration of the spring member 170 and reduce a space occupied by the spring member 170.

Further, in the image forming apparatus 1, as illustrated in FIGS. 7, and 20A to 20G, by adequately setting the positions and shapes of the guide portion 187 and the abutment portion 188 of the regulating member 180, the spring member 170 is allowed to store and release its restoring force FR1 only in a desired range of rotation of the cam member 150.

Further, in the image forming apparatus 1, the other end portion 170B of the spring member 170 abuts on the abutment portion 188 before the fourth part 154 of the cam member 150 rotating in the first direction R1 separates from the contact surface 131A of the holding member 130, that is, at the timing between the state illustrated in FIG. 20D and the state illustrated in FIG. 20E. At the moment of separation of the cam members 150 from the contact surfaces 131A of the respective holding members 130, the heating belt unit 102 urged by the tension coil springs 109 is prone to be suddenly displaced. However, with the above configuration, each spring member 170 starts to store its restoring force FR1 prior to separation of the cam member 150 from the contact surface 131A of the holding member 130. Thus, sudden displacement of the heating belt unit 102 can be suppressed by the restoring force FR1.

Further, in the image forming apparatus 1, as illustrated in FIGS. 7 and 20A, the downstream end portion 187E of the guide portion 187 in the second direction R2 is positioned away from the other end portion 170B of the spring member 170 in the second direction R2 in a state where the first part 151 of the cam member 150 is in contact with the contact surface 131A of the holding member 130. With this configuration, the spring member 170 does not store its restoring force FR1 in a state where the heating belt unit 102 is displaced to the separation position of FIG. 4. Hence, the cam member 150 is not affected by the spring member 170. As a result, the heating belt unit 102 can reliably be maintained at the separation position of FIG. 4.

Further, in the image forming apparatus 1, the other end portion 170B of the spring member 170 abuts on the abutment portion 188 after the heating belt unit 102 is brought into contact with the pressure roller 101 by the cam member 150 rotating in the first direction R1 and the second part 152 of the cam member 150 contacts and then separates from the contact surface 131A of the holding member 130. That is, the other end portion 170B of the spring member 170 abuts on the abutment portion 188 at the timing between the state illustrated in FIG. 20D and the state illustrated in FIG. 20E.

This configuration can easily set, between the pressure contact position illustrated in FIG. 6 and the separation position illustrated in FIG. 4 of the heating belt unit 102, a position at which the heating belt unit 102 is brought into pressure contact with the pressure roller 101 with a smaller pressure contact force than that at the pressure contact position, that is, the low-pressure contact position (e.g., envelope mode) illustrated in FIG. 5.

In a state where the second part 152 of the cam member 150 is in contact with the contact surface 131A of the holding member 130, the other end portion 170B of the spring member 170 is away from the abutment portion 188 as illustrated in FIG. 20D and abuts on the abutment portion 188 after the second part 152 contacts and then separates from the contact surface 131A of the holding member 130 as illustrated in FIG. 20E. That is, at the low-pressure contact position of FIG. 5, the spring member 170 does not store its restoring force FR1. Hence, the cam member 150 is not affected by the spring member 170. As a result, the heating belt unit 102 can reliably be maintained at the low-pressure contact position of FIG. 5.

Further, in the image forming apparatus 1, as illustrated in FIG. 10, the insertion hole 150H is positioned between the rotation axis X150 and the first part 151 of the cam member 150. As illustrated in FIGS. 2 and 8, the one end portion 170A of the spring member 170 is inserted into the insertion hole 150H and is thus positioned between the rotation axis X150 and the first part 151 in the cam member 150. For example, in a case where the winding diameter of the coil portion 170C of the spring member 170 is small, the abutment portion 188 abuts on and stops the other end portion 170B of the spring member 170, so that a large force acts on the cam member 150 at the very moment when the coil portion 170C of the spring member 170 starts compressing. However, with the above configuration, the winding diameter of the coil portion 170C can be set large, so that a large force can be suppressed from acting on the cam member 150 at the instant when the coil portion 170C starts compressing.

Further, in the image forming apparatus 1, as illustrated in FIGS. 2 and 8, the one end portion 170A of the spring member 170 is positioned at the cam member 150. This configuration allows the restoring force FR1 of the spring member 170 to directly act on the cam member 150. As a result, the spring member 170 can store its restoring force FR1 without deviation from the rotational posture of the cam member 150 and suppress the cam member 150 from rotating in the first direction R1. Further, the spring member 170 can release its restoring force FR1 without deviation from the rotational posture of the cam member 150 and facilitates rotation of the cam member 150 in the first direction R1.

Second Embodiment

Next, an image forming apparatus according to a second embodiment will be described with reference to FIG. 21, wherein like parts and components with those of the image forming apparatus 1 according to the first embodiment are designated with the same reference numerals to avoid duplicating description.

Figure 21:
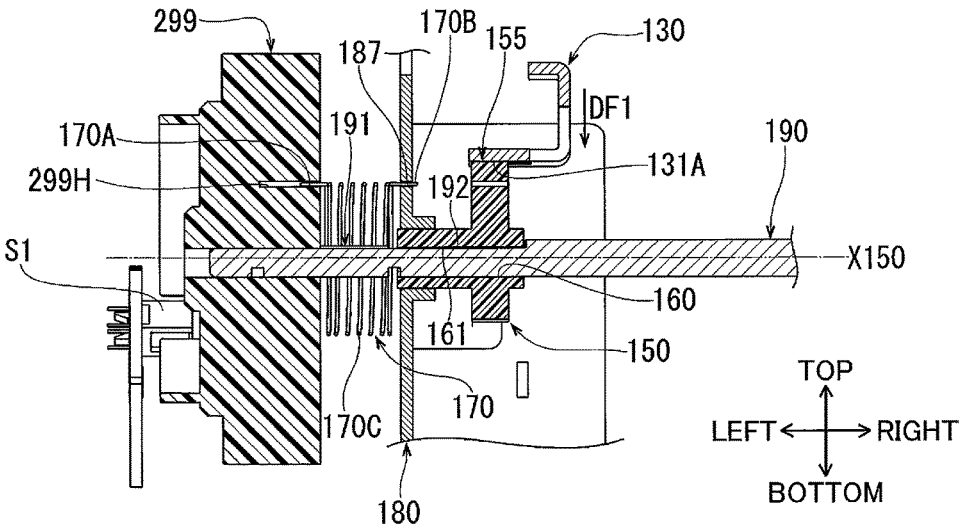
FIG. 21 is a partial cross-sectional view, similar to FIG. 8, of a cam member and a spring member of a fixing device, a regulating member, and a transmission gear provided in an image forming apparatus according to a second embodiment.

The image forming apparatus according to the second embodiment differs from the image forming apparatus 1 according to the first embodiment in the position and arrangement of the spring member 170 as illustrated in FIG. 21. Specifically, two spring members 170 are provided in the image forming apparatus 1 according to the first embodiment, whereas one spring member 170 is provided in the image forming apparatus according to the second embodiment. In the second embodiment, the spring member 170 is positioned between a transmission gear 299 and the left regulating member 180. The one end portion 170A of the spring member 170 is inserted into an insertion hole 299H recessed leftward from a right surface of the transmission gear 299. The other end portion 170B of the spring member 170 is inserted into the guide portion 187 of the left regulating member 180 from the side opposite to that in the first embodiment.

Configurations of the second embodiment other than the above are similar to those of the first embodiment.

In the image forming apparatus according to the second embodiment as well, as illustrated in FIGS. 20A to 20G, the one end portion 170A and the other end portion 170B of the spring member 170 move in accordance with rotation of the cam member 150 in the first and second directions R1 and R2, and the guide portion 187 and the abutment portion 188 of the left regulating member 180 regulates movement of the other end portion 170B of the spring member 170. Hence, the restoring force FR1 of the spring member 170 applied to the transmission gear 299 can suppress each cam member 150 from abruptly rotating in the first direction R1 and in the second direction R2 through the transmission shaft 190 to which the transmission gear 299 is coupled.

Thus, as in the image forming apparatus 1 according to the first embodiment, generation of abnormal noise can be suppressed in the image forming apparatus according to the second embodiment.

Third Embodiment

Next, an image forming apparatus according to a third embodiment will be described with reference to FIGS. 22 and 23, wherein like parts and components with those of the image forming apparatus 1 according to the first embodiment are designated with the same reference numerals to avoid duplicating description.

Figure 22:
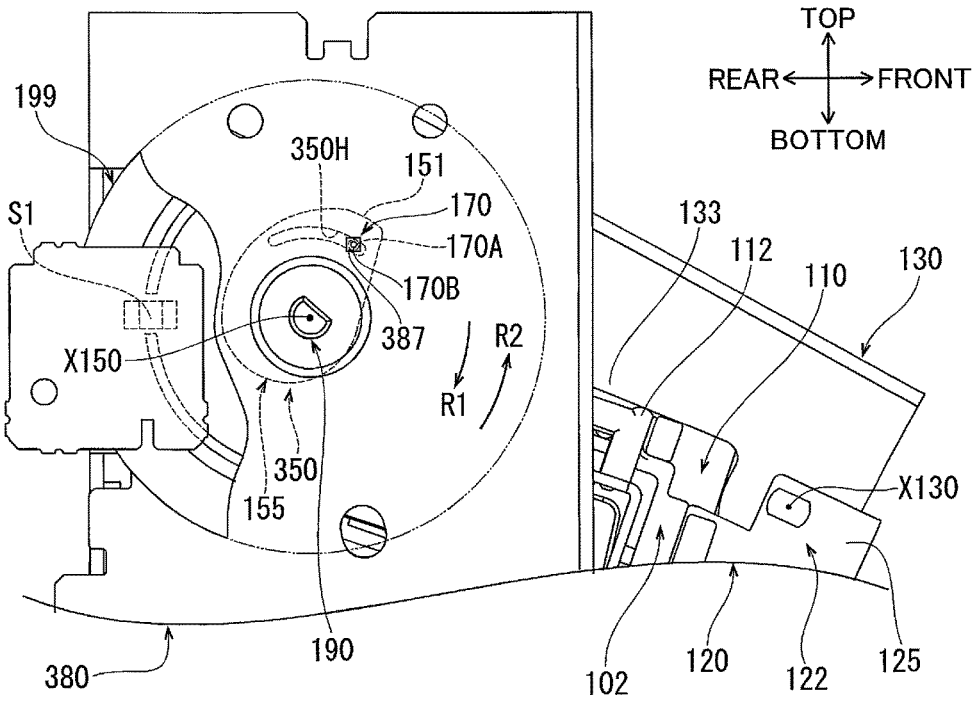
FIG. 22 is a side view of a cam member and a spring member of a fixing device, a regulating member, and a transmission gear provided in an image forming apparatus according to a third embodiment.
Figure 23:
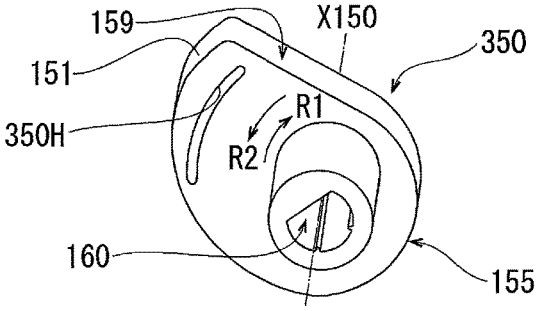
FIG. 23 is a perspective view of the cam member of the fixing device according to the third embodiment.

As illustrated in FIGS. 22 and 23, the image forming apparatus according to the third embodiment differs from the image forming apparatus 1 according to the first embodiment in that, in place of the guide portion 187 and the abutment portion 188 of the regulating member 180, a regulating hole 387 is formed in a regulating member 380. The regulating hole 387 receives the other end portion 170B of the spring member 170. The regulating hole 387 restrains the other end portion 170B of the spring member 170 so that the other end portion 170B cannot move therefrom. In FIG. 22, for the sake of simplicity, the regulating hole 387 is depicted as a square-shaped hole, and a gap is formed between the regulating hole 387 and the other end portion 170B of the spring member 170. However, only a slight gap is formed between the regulating hole 387 and the other end portion 170B.

Further, in the image forming apparatus according to the third embodiment, in place of the insertion hole 150H of the cam member 150 according to the first embodiment, an arcuate groove 350H centered on the rotation axis X150 is formed in a cam member 350. Both downstream ends of the arcuate groove 350H in the first direction R1 and the second direction R2 are closed. The arcuate groove 350H receives the one end portion 170A of the spring member 170. The arcuate groove 350H guides the one end portion 170A of the spring member 170 such that the one end portion 170A moves about the rotation axis X150. The one end portion 170A of the spring member 170 is abuttable on the downstream end portion of the arcuate groove 350H in the second direction R2 when the cam member 350 rotates a predetermined rotation angle in the first direction R1.

Configurations of the third embodiment other than the above are similar to those of the first embodiment.

In the image forming apparatus according to the third embodiment as well, the one end portion 170A of the spring member 170 abuts on the downstream end portion of the arcuate groove 350H in the second direction R2 in accordance with rotation of the cam member 350 in the first direction R1, and thus, the spring member 170 stores its restoring force FR1. Further, the spring member 170 releases its stored restoring force FR1 in accordance with rotation of the cam member 350 in the second direction R2.

Thus, as in the image forming apparatus according to the first and second embodiments, generation of abnormal noise can be suppressed in the image forming apparatus according to the third embodiment.

Fourth Embodiment

Next, an image forming apparatus according to a fourth embodiment will be described with reference to FIGS. 24 and 25, wherein like parts and components with those of the image forming apparatus 1 according to the first embodiment are designated with the same reference numerals to avoid duplicating description.

Figure 24:
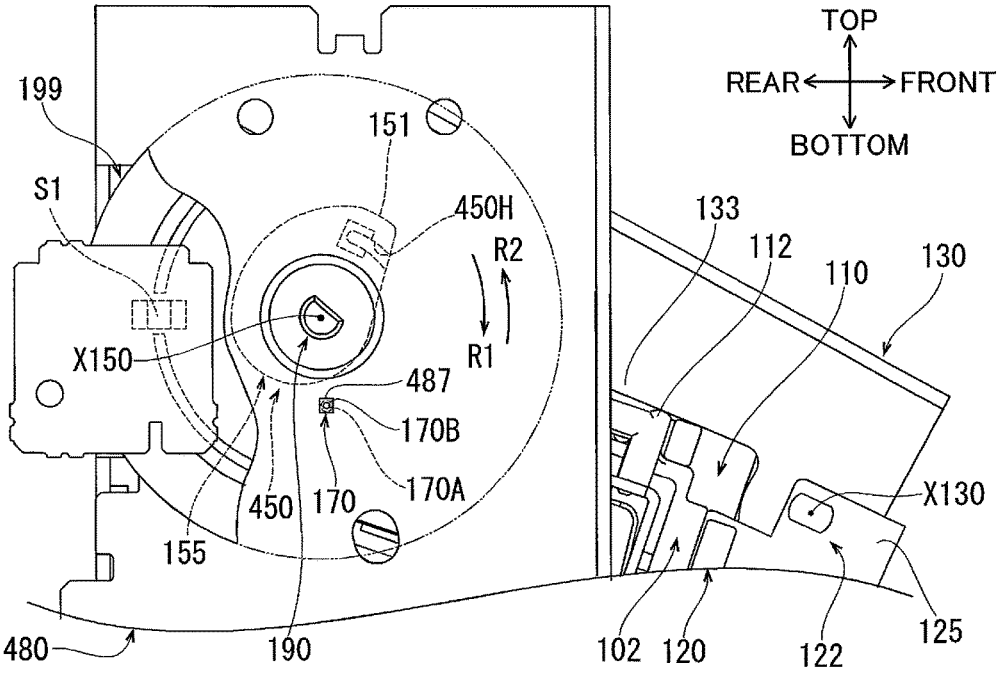
FIG. 24 is a side view of a cam member and a spring member of a fixing device, a regulating member, and a transmission gear of an image forming apparatus according to a fourth embodiment.
Figure 25:
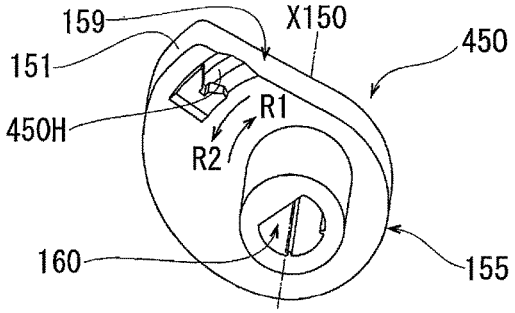
FIG. 25 is a perspective view of the cam member of the fixing device according to the fourth embodiment.

As illustrated in FIGS. 24 and 25, the image forming apparatus according to the fourth embodiment differs from the image forming apparatus 1 according to the first embodiment in that, in place of the guide portion 187 and the abutment portion 188 of the regulating member 180, a regulating hole 487 is formed in a regulating member 480. The regulating hole 487 is positioned substantially immediately below the rotation axis X150. The regulating hole 487 receives the other end portion 170B of the spring member 170. The regulating hole 487 restrains the other end portion 170B of the spring member 170 so that the other end portion 170B cannot move therefrom. In FIG. 24, for the sake of simplicity, the regulating hole 487 is depicted as a square-shaped hole, and a gap is formed between the regulating hole 487 and the other end portion 170B of the spring member 170. However, only a slight gap is formed between the regulating hole 487 and the other end portion 170B.

Further, in the image forming apparatus according to the fourth embodiment, in place of the insertion hole 150H of the cam member 150 according to the first embodiment, an arcuate groove 450H centered on the rotation axis X150 is formed in a cam member 450. A downstream end of the arcuate groove 450H in the first direction R1 is opened, while a downstream end of the arcuate groove 450H in the second direction R2 is closed. When the cam member 450 rotates a predetermined rotation angle in the first direction R1, the one end portion 170A of the spring member 170 enters the arcuate groove 450H to be guided therealong. When the cam member 450 further rotates in the first direction R1, the one end portion 170A of the spring member 170 abuts on the downstream end of the arcuate groove 450H in the second direction R2.

Configurations of the fourth embodiment other than the above are similar to those of the first embodiment.

In the image forming apparatus according to the fourth embodiment as well, the one end portion 170A of the spring member 170 abuts on the downstream end of the arcuate groove 450H in the second direction R2 in accordance with rotation of the cam member 450 in the first direction R1, and thus, the spring member 170 stores its restoring force FR1. Further, the spring member 170 releases its stored restoring force FR1 in accordance with rotation of the cam member 450 in the second direction R2.

Thus, as in the image forming apparatus according to the first to third embodiments, generation of abnormal noise can be suppressed in the image forming apparatus according to the fourth embodiment.

Fifth Embodiment

Next, an image forming apparatus according to a fifth embodiment will be described with reference to FIGS. 26 to 27C, wherein like parts and components with those of the image forming apparatus 1 according to the first embodiment are designated with the same reference numerals to avoid duplicating description.

Figure 26:
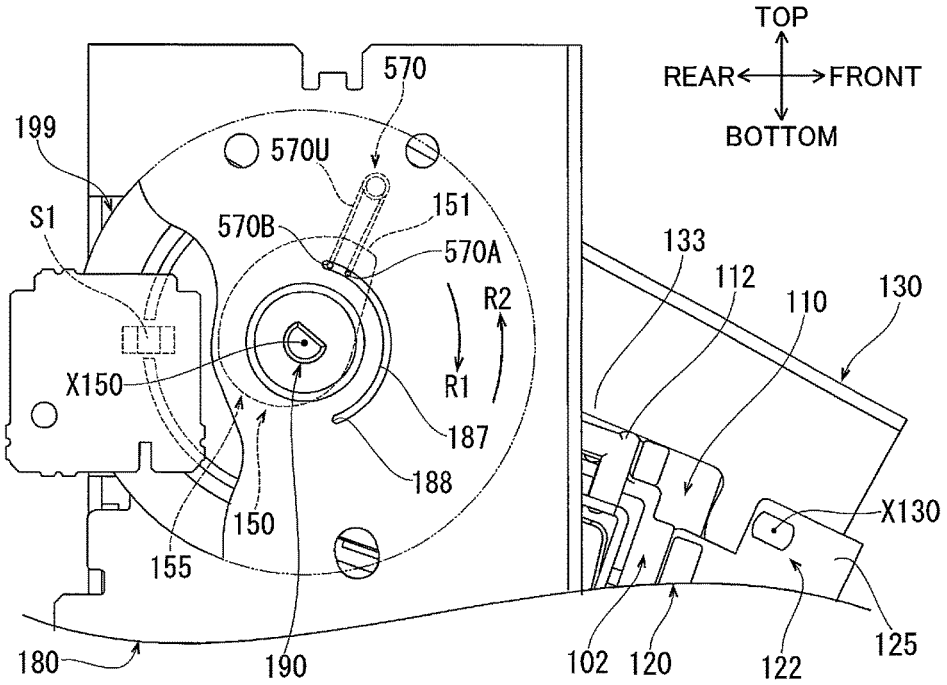
FIG. 26 is a side view of a cam member and a spring member of a fixing device, a regulating member, and a transmission gear provided in an image forming apparatus according to a fifth embodiment.
Figure 27A:
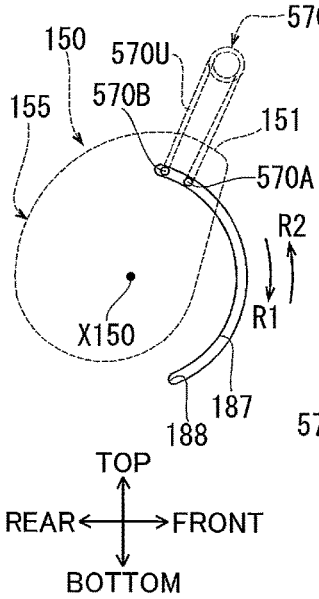
FIG. 27A is a schematic side view for description how the spring member and the regulating member operate in accordance with rotation of the cam member according to the fifth embodiment.
Figure 27B:
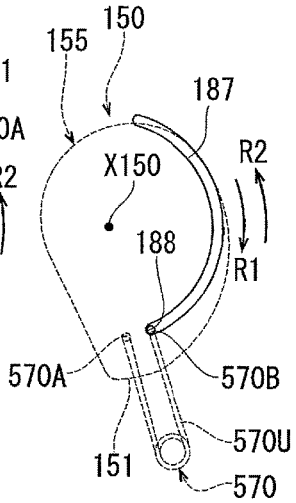
FIG. 27B is a schematic side view for description how the spring member and the regulating member operate in accordance with rotation of the cam member according to the fifth embodiment, illustrating a state where the cam member further rotates in the first direction from a position illustrated in FIG. 27A.
Figure 27C:
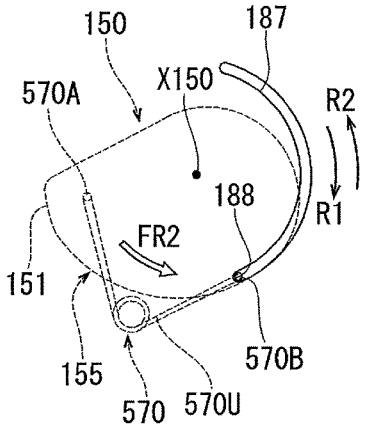
FIG. 27C is a schematic side view for description how the spring member and the regulating member operate in accordance with rotation of the cam member according to the fifth embodiment, illustrating a state where the cam member further rotates in the first direction from a position illustrated in FIG. 27B.

As illustrated in FIGS. 26 to 27C, the image forming apparatus according to the fifth embodiment differs from the image forming apparatus 1 according to the first embodiment in that, in place of the spring member 170, a spring member 570 is provided. Similar to the one end portion 170A of the spring member 170 according to the first embodiment, one end portion 570A of the spring member 570 is inserted into the insertion hole 150H of the cam member 150. Further, similar to the other end portion 170B of the spring member 170 according to the first embodiment, the other end portion 570B of the spring member 570 is inserted into the guide portion 187 of the regulating member 180. The spring member 570 has a U-shaped portion 570U between the one end portion 570A and the other end portion 570B. The U-shaped portion 570U extends from the one end portion 570A radially outward with respect to the rotation axis X150, and is wound in a form of coil, and then, extends radially inward with respect to the rotation axis X150 to be connected to the other end portion 570B.

Configurations of the fifth embodiment other than the above are similar to those of the first embodiment.

As illustrated in FIGS. 27A to 27C, in the image forming apparatus according to the fifth embodiment, the one end portion 570A and the other end portion 570B of the spring member 570 move in accordance with rotation of the cam member 150 in the first direction R1. As illustrated in FIG. 27B, when the cam member 150 rotates a predetermined rotation angle in the first direction R1, the other end portion 570B of the spring member 570 abuts on the abutment portion 188. The abutment portion 188 restricts the other end portion 570B from moving further in the first direction R1. As a result, as illustrated in FIG. 27C, only the one end portion 570A of the spring member 570 moves in the first direction R1, and thus, the spring member 570 stores its restoring force FR2. Further, the spring member 570 releases its stored restoring force FR2 in accordance with rotation of the cam member 150 in the second direction R2.

Thus, as in the first to fourth embodiments, generation of abnormal noise can be suppressed in the image forming apparatus according to the fifth embodiment.

<Modifications>

While the description has been made in detail with reference to the embodiments thereof, it would be apparent to those skilled in the art that many modifications and variations may be made therein without departing from the scope of the disclosure.

The drive source and the transmission section are not limited to those of the above-described embodiments. For example, a motor for driving the cam member may be provided in addition to the motor for driving the pressure roller. Further, a drive source incapable of reverse rotation but capable of normal rotation or stopping the normal rotation may be used to rotate the cam member in the first direction and the second direction by changing over the rotational direction at the transmission section on the way to the cam members.

The first fixing member and the second fixing member are not limited to those of the above-described embodiments. For example, the first fixing member is a heat roller, and the second fixing member is a pressure roller that is movable toward and away from the heat roller.

The holding member may not be pivotally movably supported, but may be linearly movably supported. Further, the low-pressure contact position illustrated in FIG. 5 is not essential, but may be omitted.

A configuration in which the cam surface allows displacement of the holding member in the urging direction is not limited to the configuration in which the cam surface 155 is separated from the contact surface 131A of the holding member 13, as illustrated in FIG. 17. For example, a configuration in which the cam surface maintains contact with the holding member may be available.

While "one of the separation position and the pressure contact position" in the present disclosure is the pressure contact position in the above-described embodiments and "the other of the separation position and the pressure contact position" in the present disclosure is the separation position in the above-described embodiments, a configuration in reverse, i.e., a configuration in which "the cam member rotates in the first direction to displace the second fixing member to the separation position while rotating in the second direction to displace the second fixing member to the pressure contact position" is also available in the present disclosure.

The shape and material of the spring member are not limited to those in the above-described embodiments. For example, a wire or a plate formed into a resiliently deformable shape may be used as the spring member. Further, the material of the spring member is not limited to metal, and may be fiber-reinforced plastic.

The above-described configuration may also be available to other type of image forming apparatus, such as a multifunction peripheral and the like.

What is claimed is:

1. An image forming apparatus comprising:

a first fixing member;

a second fixing member configured to nip and heat a recording sheet in cooperation with the first fixing member to fix a developer image onto the recording sheet;

a holding member holding the second fixing member such that the second fixing member can be displaced between a pressure contact position and a separation position, the second fixing member in the pressure contact position being in pressure contact with the first fixing member, and the second fixing member in the separation position being positioned away from the first fixing member;

a cam member rotatable about a rotation axis in a first direction and a second direction opposite to the first direction, the cam member having a cam surface, a distance between the cam surface and the rotation axis being reduced in the second direction;

an urging member urging the holding member in an urging direction such that the holding member moves toward the cam surface;

a spring member having one end portion and another end portion, the one end portion being movable in interlocking relation with the cam member, the spring member being configured:

to store a restoring force by the rotation of the cam member in the first direction and to suppress rotation of the cam member in the first direction; and to release the restoring force by the rotation of the cam member in the second direction and to facilitate rotation of the cam member in the second direction;

a drive source configured to generate a drive force for rotating the cam member in the first direction and the second direction;

a transmission section configured to transmit the drive force to the cam member;

a regulating member configured to regulate movement of the another end portion; and a controller configured to control the drive source:

to provide rotation of the cam member in the first direction, permitting the cam surface to allow the holding member to be displaced in the urging direction to displace the second fixing member to one of the separation position and the pressure contact position; and to provide rotation of the cam member in the second direction, permitting the cam surface to allow the holding member to be displaced in a direction opposite to the urging direction to displace the second fixing member to remaining one of the separation position and the pressure contact position.

2. The image forming apparatus according to claim 1, wherein the spring member includes a coil portion positioned between the one end portion and the another end portion, the coil portion being in a form of a coil through which the rotation axis extends.

3. The image forming apparatus according to claim 1, wherein the regulating member comprises:

a guide portion configured to guide the another end portion of the spring member such that the another end portion moves about the rotation axis, the guide portion having a downstream end portion in the first direction; and an abutment portion provided at the downstream end portion and on which the another end portion of the spring member is abuttable.

4. The image forming apparatus according to claim 3, wherein the urging member is configured to urge the second fixing member in the urging direction such that the second fixing member moves toward the first fixing member, wherein the cam member is configured to allow the cam surface to move away from the holding member by the rotation of the cam member in the first direction to displace the second fixing member to the pressure contact position, and configured to displace the second fixing member to the separation position by the rotation of the cam member in the second direction, wherein the cam surface includes a prescribed part separating from the holding member during displacement of the second fixing member to the pressure contact position after the second fixing member contacts the first fixing member, and wherein the abutment portion is configured to allow the another end portion of the spring member to abut on the abutment portion prior to separation of the prescribed part from the holding member during the rotation of the cam member in the first direction.

5. The image forming apparatus according to claim 4, wherein the cam surface includes a first part providing a first distance from the rotation axis, the first distance being the largest distance between the rotation axis and the cam surface, wherein the rotation of the cam member in the second direction permits the first part to contact the holding member to displace the second fixing member to the separation position, and wherein the guide portion has a downstream end portion in the second direction positioned away from the another end portion of the spring member in a state where the first part is in contact with the holding member.

6. The image forming apparatus according to claim 5, wherein the cam surface further includes a second part away from the first part about the rotation axis by a predetermined distance in the second direction, the second part providing a second distance from the rotation axis, the second distance being smaller than the first distance, wherein the second part extends about the rotation axis with a predetermined length while maintaining the second distance, and wherein the abutment portion is configured to allow the another end portion of the spring member to abut on the abutment portion after the second fixing member is in contact with the first fixing member and the second part is separated from the holding member subsequent to contact with the holding member by the rotation of the cam member in the first direction.

7. The image forming apparatus according to claim 5, wherein the one end portion of the spring member is positioned between the rotation axis and the first part.

8. The image forming apparatus according to claim 1, wherein the one end portion of the spring member is positioned at the cam member.

* * * * *